US005384234A

United States Patent [19]

Ueda et al.

[11] Patent Number: 5,384,234

[45] Date of Patent: Jan. 24, 1995

[54] SILVER HALIDE COLOR PHOTOGRAPHIC PHOTOSENSITIVE MATERIALS

[75] Inventors: Fumitaka Ueda; Junji Nishigaki; Akihiko Ikegawa, all of Kanagawa, Japan

[73] Assignee: Fuji Photo Film Co., Ltd., Kanagawa, Japan

[21] Appl. No.: 85,174

[22] Filed: Jul. 2, 1993

[30] Foreign Application Priority Data

Jul. 6, 1992 [JP] Japan ..... 4-200165

[51] Int. Cl.[6] ..... G03C 1/46

[52] U.S. Cl. ..... 430/504; 430/505; 430/544; 430/576; 430/583; 430/359; 430/362

[58] Field of Search ..... 430/504, 544, 576, 505, 430/359, 362, 550, 583

[56] References Cited

U.S. PATENT DOCUMENTS

| | | | |
|---|---|---|---|
| 3,933,510 | 1/1976 | Shiba et al. | 430/574 |
| 3,990,899 | 11/1976 | Shiba et al. | 430/362 |
| 4,705,744 | 11/1987 | Sasaki et al. | 430/505 |
| 4,729,943 | 3/1988 | Pfaff et al. | 430/504 |
| 5,166,042 | 11/1992 | Nozawa | 430/505 |
| 5,180,657 | 1/1993 | Fukazawa et al. | 430/574 |
| 5,262,287 | 11/1993 | Deguchi et al. | 430/504 |

FOREIGN PATENT DOCUMENTS

| | | |
|---|---|---|
| 0438148 | 7/1991 | European Pat. Off. . |
| 2198168 | 3/1974 | France . |

*Primary Examiner*—Charles L. Bowers, Jr.

*Assistant Examiner*—Geraldine Letscher

*Attorney, Agent, or Firm*—Sughrue, Mion, Zinn, Macpeak & Seas

[57] ABSTRACT

The present invention provides a silver halide color photographic photosensitive material which has high saturation, excellent color reproduction and excellent graininess, the material comprising a silver halide emulsion layer which imparts an interlayer effect to a red sensitive silver halide emulsion layer is spectrally sensitized with a sensitizing dye represented by formula (I) and contains a development inhibitor releasing compound represented by formula (II).

(I)

(II)

11 Claims, No Drawings

SILVER HALIDE COLOR PHOTOGRAPHIC PHOTOSENSITIVE MATERIALS

FIELD OF THE INVENTION

This invention concerns color photographic photosensitive materials and, more precisely, it concerns color photographic photosensitive materials which have high saturation, excellent color reproduction and excellent graininess.

BACKGROUND OF THE INVENTION

In the past, the use of the inter-layer inhibiting effect was known as a means of improving color reproduction in color photographic photosensitive materials. Taking color negative sensitive materials as an example, it is possible to suppress the formation of color in the red sensitive layer on white light exposure to a greater extent than in the case of red light exposure by imposing a development inhibiting effect from the green sensitive layer to the red sensitive layer. The color negative paper system is such that on exposure to white light, the gradation is balanced so as to reproduce gray on the color print and so the aforementioned interlayer effect gives a higher density cyan color formation on red light exposure than with gray exposure. As a result, it is possible to suppress cyan color formation on the print and reproduce a red color which has a higher degree of saturation. Similarly, a development inhibiting effect from the red sensitive layer to the green sensitive layer gives green reproduction with a high degree of saturation.

The method in which use is made of iodine ions which are released from the silver halide emulsion during development is known for increasing the interlayer effect. That is to say, in this method the silver iodide content of the donor layer of the interlayer effect is increased and the silver iodide content of the acceptor layer is reduced. Another method of increasing the inter-layer effect involves adding couplers which release development inhibitors on reaction with the oxidation products of the developing agent in a paraphenylenediamine based color developer to the donor layer of the inter-layer effect, as disclosed in JP-A-50-2537. (The term "JP-A" as used herein signifies an "unexamined published Japanese patent application".) Another method of increasing the interlayer effect is known as auto-masking. In this method, a colored coupler is added for a colorless coupler to mask the unwanted absorptions of the colored dye of the colorless coupler. The methods depending on colored couplers increase the amounts added and provide masking beyond the masking of the unwanted absorption of the colorless couplers, and they can provide an effect which is the same as the interlayer effect.

If the saturation of the red, green and blue primary colors is increased using these methods, there is a disadvantage in that the green hue from yellow and cyan is not reproduced faithfully, and the technique disclosed in JP-A-61-34541 has been proposed to counter this disadvantage. This technique provides bright and faithful color reproduction by means of silver halide color photographic photosensitive materials comprising a support having thereon at least one blue sensitive silver halide emulsion layer which contains a color coupler which forms a yellow color, at least one green sensitive silver halide emulsion layer which contains a color coupler which forms a magenta color and at least one red sensitive emulsion layer which contains a color coupler which forms a cyan color, wherein the sensitivity wavelength at the center of gravity of the spectral sensitivity distribution of the green sensitive layer ($\lambda_G$) is 520 nm$\leqq\lambda_G\leqq$580 nm, and the center of gravity wavelength of the distribution of the size of the interlayer effect which is received by at least one red sensitive silver halide emulsion layer which forms a cyan color from the other layers in the region from 500 nm to 600 nm ($\lambda_{-R}$) is 500 nm$\leqq\lambda_{-R}\leqq$560 nm, and $\lambda_G-\lambda_{-R}\geqq$5 nm.

A interlayer effect on the green sensitive layer also arises from the layer which imparts the interlayer effect on a red sensitive layer. In order to prevent the imposition of undesirable effects on color reproduction, it is desirable that the layer which imparts the interlayer effect on a red sensitive layer forms a magenta color.

It is known that graininess of human skin is liable to arise on color prints on taking photographs using sensitive materials which have been obtained in this way. On analyzing the cause of this effect, it is found to be due to the fact that the graininess of the magenta color formation by the silver halide emulsion layer which imparts a interlayer effect to the red sensitive layer is poor in comparison with the graininess of the other color forming layers.

The reason why the graininess of the layer which imparts the interlayer effect to the red sensitive layer is worse than the graininess of the other silver halide emulsion layers is because the sensitizing dyes (center of gravity wavelength: 500 nm$<\lambda_{-R}<$560 nm) used conventionally in the silver halide emulsion layers for providing the interlayer effect have had a low color sensitizing efficiency because of their weak absorption, so that the speed/graininess ratio becomes poor.

Hence, a demand has arisen for sensitizing dyes which provide a strong absorption (spectral sensitivity) in the center of gravity wavelength range from 500 to 560 nm (and preferably in the range from 520 to 540 nm) from the viewpoint of color reproduction.

SUMMARY OF THE INVENTION

To meet the above-described demand, the present invention provides a silver halide color photosensitive material comprising a support having thereon at least one blue sensitive silver halide emulsion layer which contains a yellow color forming color coupler, at least one green sensitive silver halide emulsion layer which contains a magenta color forming color coupler and at least one red sensitive silver halide emulsion layer which contains a cyan color forming color coupler, and in which at least one silver halide emulsion layer imparts a interlayer effect to the red sensitive emulsion layer, wherein the layer which imparts the interlayer effect is spectrally sensitized with a sensitizing dye represented by formula (I) as shown below and includes a development inhibitor releasing compound represented by formula (II) as shown below.

Formula (I)

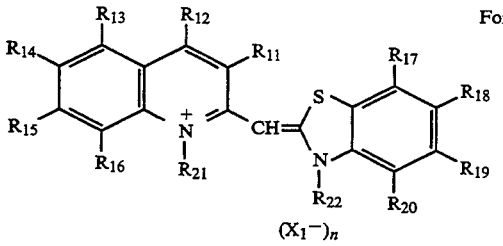

In this formula, $R_{11}$, $R_{12}$, $R_{13}$, $R_{14}$, $R_{15}$, $R_{16}$, $R_{17}$, $R_{18}$, $R_{19}$ and $R_{20}$ may be the same or different, each representing a hydrogen atom, an alkyl group, an aryl group, an alkoxy group, an aryloxy group, a halogen atom, an aryloxycarbonyl group, an alkoxycarbonyl group, an amino group, an acyl group, a cyano group, a carbamoyl group, a sulfamoyl group, a carboxyl group or an acyloxy group. $R_{21}$ and $R_{22}$ may be the same or different, each representing an alkyl group. $X^-_1$ represents a counteranion, n is 0 or 1, and n=0 in cases where an intramolecular salt is formed.

Formula (II)

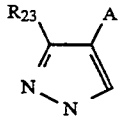

Z

In this formula, $R_{23}$ represents a hydrogen atom or a substituent group. Z represents a group of non-metal atoms which is required to form a five-membered azole ring which contains from 2 to 4 nitrogen atoms, wherein the azole ring may have substituent groups. A represents a group which is eliminated by a coupling reaction with an oxidized form of a developing agent to form a development inhibitor or a precursor thereof, or A represents a group which is eliminated by a coupling reaction with an oxidized form of a developing agent and then reacts with another molecule of an oxidized form of the developing agent to form a development inhibitor or a precursor thereof.

The present invention also provides silver halide color photosensitive material having a red sensitive emulsion layer which imparts a interlayer effect on the red sensitive emulsion layer, wherein a sensitizing dye represented by formula (III) as shown below is included in the layer which imparts a interlayer effect on the red sensitive emulsion layer.

Formula (III)

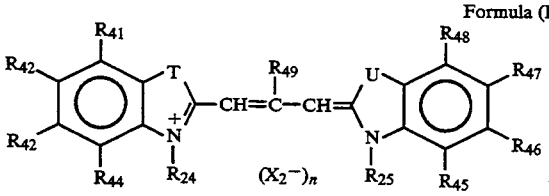

In this formula, $R_{41}$ to $R_{48}$ have the same meaning as $R_{11}$, and $R_{24}$ and $R_{25}$ have the same meaning as $R_{21}$. T and U are either oxygen atoms, sulfur atoms or selenium atoms and may be the same or different. $X_2^-$ has the same meaning as $X_1^-$. $R_{49}$ represents a hydrogen atom, an alkyl group or an aryl group.

DETAILED DESCRIPTION OF THE INVENTION

The invention is described in detail below.

A photosensitive material of the present invention is a color photosensitive material comprising a support having thereon at least one blue sensitive silver halide emulsion layer which contains a yellow forming color coupler, at least one green sensitive silver halide emulsion layer which contains a magenta color forming coupler and at least one red sensitive silver halide emulsion layer which contains a cyan color forming color coupler, and it is characterized firstly by the fact that at least one red sensitive silver halide emulsion layer which forms a cyan color is restrained by a interlayer effect from a interlayer effect donor layer which is spectrally sensitized with a sensitizing dye represented by formula (I) as shown below.

Formula (I)

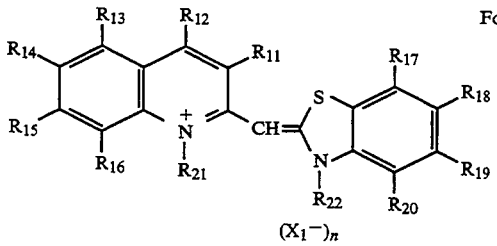

In this formula, $R_{11}$, $R_{12}$, $R_{13}$, $R_{14}$, $R_{15}$, $R_{16}$, $R_{17}$, $R_{18}$, $R_{19}$ and $R_{20}$ may be the same or different, each representing a hydrogen atom, an alkyl group (including alkyl groups which have substituent groups), an aryl group (including aryl groups which have substituent groups), an alkoxy group (including alkoxy groups which have substituent groups), an aryloxy group (including aryloxy groups which have substituent groups), a halogen atom, an alkoxycarbonyl group (including alkoxycarbonyl groups which have substituent groups), an aryloxycarbonyl group (including aryloxycarbonyl groups which have substituent groups), an acylamino group (including acylamino groups which have substituent groups), an acyl group (including acyl groups which have substituent groups), a cyano group, a carbamoyl group (including carbamoyl groups which have substituent groups), a sulfamoyl group (including sulfamoyl groups which have substituent groups), a carboxyl group or an acyloxy group (including acyloxy groups which have substituent groups).

$R_{21}$ and $R_{22}$ may be the same or different, each representing a substituted or unsubstituted alkyl group.

$X_1^-$ represents a counteranion, n is 0 or 1, and n=0 in cases where an intramolecular salt is formed.

Preferred examples of each of the substituent groups in the compounds represented by formula (I) which are used in the present invention are indicated below. That is to say, $R_{11}$, $R_{12}$, $R_{13}$, $R_{14}$, $R_{15}$, $R_{16}$, $R_{17}$, $R_{18}$, $R_{19}$ and $R_{20}$ are preferably alkyl groups of carbon number 10 or less {for example, methyl, ethyl, propyl, isopropyl, butyl, branched butyl (for example, isobutyl, tert-butyl), pentyl, branched pentyl (for example, isopentyl, tert-pentyl), vinylmethyl, cyclohexyl}, aryl groups of carbon number 10 or less (for example, phenyl, 4-methylphenyl, 4-chlorophenyl, naphthyl), aralkyl groups of carbon number 10 or less (for example benzyl, phenethyl, 3-phenylpropyl), alkoxy groups of carbon number 10 or less (for example, methoxy, ethoxy, propyloxy, butyloxy, pentyloxy, benzyloxy, phenethyloxy), aryloxy groups of carbon number 10 or less (for example, phenoxy, 4-methylphenoxy, 4-chlorophenoxy, naphthyloxy), halogen atoms (for example, fluorine, chlorine, bromine, iodine), haloalkyl groups (for example, trifluoromethyl), alkoxycarbonyl groups of carbon number 10 or less (for example, methoxycarbonyl, ethoxycarbonyl, benzyloxycarbonyl), aryloxycarbonyl groups of carbon number 10 or less (for example, phenyloxycarbonyl, 4-methylphenyloxycarbonyl, 4-chlorophenyloxycarbonyl, naphthyloxycarbonyl), acylamino groups of carbon number 8 or less (for example, acetylamino, propionylamino, benzoylamino), acyl groups of carbon number 10 or less (for example, acetyl, propionyl, benzoyl, mesyl), cyano groups, carbamoyl groups of carbon number 6 or less (for example, carbamoyl, N,N-dimethylcarbamoyl, morpholinocarbonyl), sulfamoyl groups of carbon number 6 or less (for example, sulfamoyl, N,N-dimethylsulfamoyl, morpholinosulfonyl, piperidinosulfonyl), carboxyl groups, or acyloxy groups of carbon number 10 or less (for example, acetyloxy, propionyloxy, benzoyloxy).

Compounds in which $R_{11}$ and $R_{13}$ are hydrogen atoms, $R_{12}$ is a chlorine atom or a phenyl group and $R_{14}$ is a chlorine atom or a phenyl group are most desirable.

$R_{21}$ and $R_{22}$ may be, for example, alkyl groups of carbon number 8 or less (for example, methyl, ethyl, propyl, vinylmethyl, butyl, pentyl, hexyl, heptyl, octyl), or aralkyl groups of carbon number 10 or less (for example, benzyl, phenethyl, 3-phenylpropyl). Substituent groups for $R_{21}$ and $R_{22}$ include, for example, hydroxyl group, carboxyl group, sulfo group, cyano group, halogen atom (for example fluorine, chlorine, bromine), alkoxycarbonyl groups of carbon number 8 or less (for example, methoxycarbonyl, ethoxycarbonyl, benzyloxycarbonyl), alkoxy groups of carbon number 8 or less (for example, methoxy, ethoxy, butyloxy, benzyloxy, phenethyloxy), aryloxy groups of carbon number 8 or less (for example, phenoxy, tolyloxy), acyloxy groups of carbon number 8 or less (for example acetyloxy, propionyloxy, benzoyloxy), acyl groups of carbon number 8 or less (for example, acetyl, propionyl, benzoyl, 4-fluorobenzoyl), carbamoyl groups of carbon number 6 or less (for example, carbamoyl, N,N-dimethylcarbamoyl, morpholinocarbonyl, piperidinocarbonyl, methanesulfonylaminocarbonyl), sulfamoyl groups of carbon number 6 or less (for example, sulfamoyl, N,N-dimethylsulfamoyl, morpholinosulfonyl, piperidinosulfonyl, acetylaminosulfonyl) and aryl groups of carbon number 10 or less (for example, phenyl, p-fluorophenyl, p-hydroxyphenyl, p-carboxyphenyl, p-sulfophenyl).

$R_{21}$ and $R_{22}$ are preferably sulfoethyl groups, sulfopropyl groups, sulfobutyl groups, 1-methylsulfopropyl groups, carboxymethyl groups or carboxyethyl groups, and they are most desirably sulfopropyl groups or sulfobutyl groups.

Actual examples of compounds represented by formula (I) of the present invention are indicated below, but the scope of the invention is not limited by these examples.

I-1

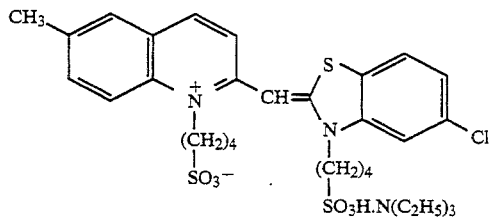

I-2

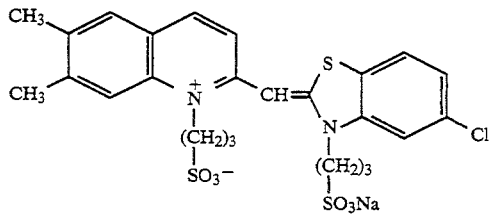

I-3

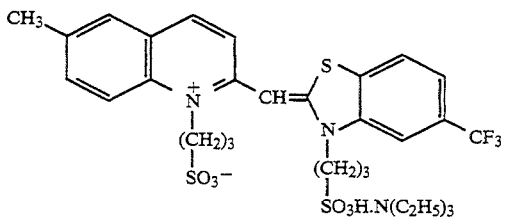

I-4

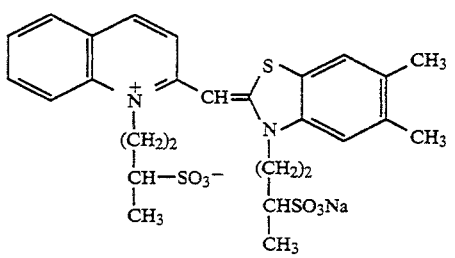

I-5

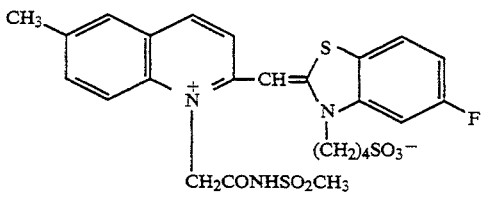

I-6

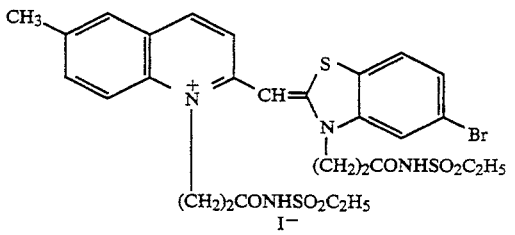

I-7

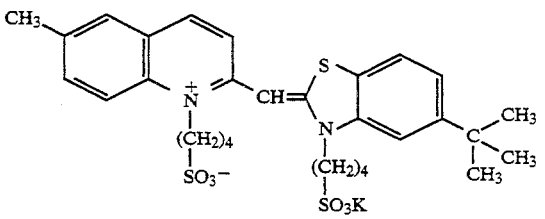

-continued

I-8

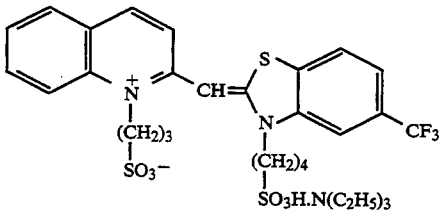

I-9

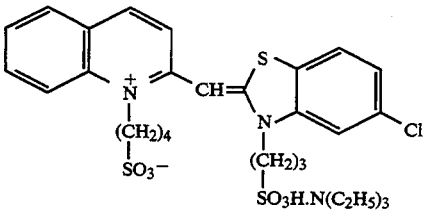

I-10

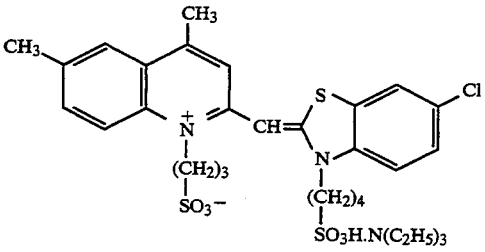

The amount of the dye of formula (I) which is used is such that the amount added in practice is from $4\times10^{-6}$ to $2\times10^{-2}$ mol per mol of silver halide, but the addition of from $5\times10^{-5}$ to $5\times10^{-3}$ mol per mol of silver halide is preferred. Furthermore, the addition of the dye to the emulsion can be made at any stage during the preparation of the emulsion which has been known for this purpose in the past.

It is clear from the results of investigations that stronger spectral sensitization is achieved by using dyes of formula (I) conjointly with sensitizing dyes represented by formula (III) which is indicated below.

Formula (III)

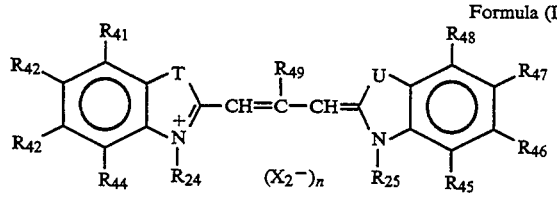

In this formula, $R_{41}$ to $R_{48}$ are the same as $R_{11}$ in formula (I), and $R_{24}$ and $R_{25}$ are the same as $R_{21}$ in formula (I). T and U may be the same or different, each being an oxygen atom, a sulfur atom or a selenium atom, and $X_2^-$ is the same as $X_1^-$ in formula (I). n is 0 or 1, and n=0 in cases where an intramolecular salt is formed. $R_{49}$ represents a hydrogen atom, an alkyl group (including alkyl groups which have substituent groups) or an aryl group (including aryl groups which have substituent groups).

Preferred examples of compounds represented by formula (III) of the present invention are tabulated below, but the scope of the present invention is not limited by these examples.

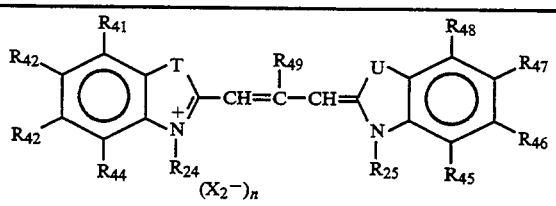

| Compound | T | U | $R_{24}$ | $R_{25}$ | $R_{41}$ | $R_{42}$ | $R_{43}$ | $R_{44}$ | $R_{45}$ | $R_{46}$ | $R_{47}$ | $R_{48}$ | $R_{49}$ |
|---|---|---|---|---|---|---|---|---|---|---|---|---|---|
| III-1 | O | O | $-(CH_2)_4SO_3Na$ | $-(CH_2)_2SO_3^-$ | H | H | $-C_5H_{11}(t)$ | H | H | | H | H | $-C_2H_5$ |
| III-2 | O | O | $-(CH_2)_2CH(CH_3)SO_3^-$ | $-(CH_2)_2CH(CH_3)SO_3K$ | H | H | | H | H | Cl | H | H | $-C_2H_5$ |
| III-3 | O | S | $-(CH_2)_2SO_3^-$ | $-(CH_2)_4SO_3K$ | H | H | | H | H | $-CH_3$ | $-CH_3$ | H | $-C_2H_5$ |
| III-4 | O | O | $-(CH_2)_3SO_3^-$ | $-(CH_2)_3SO_3Na$ | H | H | | H | H | Cl | H | H | $-C_2H_5$ |
| III-5* | S | S | $-C_2H_5$ | $-C_2H_5$ | H | H | Cl | H | H | Cl | H | H | $-C_2H_5$ |
| III-6 | O | O | $-(CH_2)_2CH(CH_3)SO_3^-$ | $-(CH_2)_2CH(CH_3)SO_3H$ | H | H | | H | H | Cl | H | H | $-C_2H_5$ |
| III-7 | O | S | $-(CH_2)_2SO_3^-$ | $-(CH_2)_4SO_3K$ | H | H | | H | H | $-CH_3$ | $-CH_3$ | H | $-C_2H_5$ |

(Note)
*In III-5, $X_2^-$ is $I^-$

The dyes of formula (III) can be used conjointly in any proportions with the dyes of formula (I), but the use of an amount within the range from 0.5 mol % to 80 mol % of the amount of the dye of formula (I) which is being used is more desirable.

The compounds represented by formulas (I) and (III) of the present invention can be prepared on the basis of methods disclosed, for example, by F. M. Hamer in *Heterocyclic Compounds - Cyanine Dyes and Related Compounds,* John Wiley & Sons, New York and London, 1964, by D. M. Sturmer in *Heterocyclic Compounds - Special Topics in Heterocyclic Chemistry,* chapter 18, section 14, pages 482 to 515, John Wiley & Sons, New York and London, 1977, and in *Rodd's Chemistry of Carbon Compounds,* 2nd Ed., Vol. IV, part B, 1977), chapter 15, pages 369 to 422, 2nd Ed., Vol. IV, part B, 1985, chapter 15, pages 267 to 296, Elsevier Science Publishing Company Inc., New York.

The use of compounds represented by formula (II) as the development inhibitor releasing compounds which are used in the donor layer for the interlayer effect is necessary for improving color reproduction which is one of the aims of this present invention.

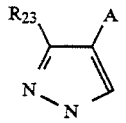

Formula (II)

Z

The compounds of formula (II) used in the invention are described in detail below. The preferred skeletons from among the coupler skeletons which can be represented by formula (II) are 1H-imidazo[1,2-b]pyrazole, 1H-pyrazolo[1,5-b][1,2,4]-triazole, 1H-pyrazolo[5,1-c][1,2,4]triazole and 1H-pyrazolo[1,5-d]tetrazole, and these can be represented by the formulae (P-1), (P-2), (P-3) and (P-4).

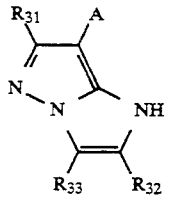

(P-1)

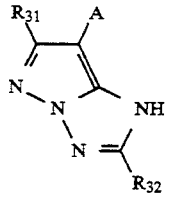

(P-2)

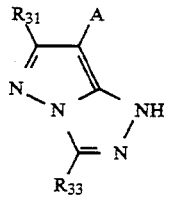

(P-3)

-continued

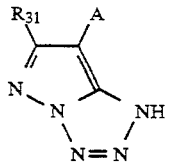

(P-4)

The substituent groups $R_{31}$, $R_{32}$, $R_{33}$ and A in these formulae will be described in detail.

$R_{31}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group, and $R_{31}$ may be a divalent group and form bis-forms.

More precisely, $R_{31}$ can represent a hydrogen atom, a halogen atom (for example, chlorine, bromine), an alkyl group (for example, a linear chain or branched alkyl group, alkenyl group, alkynyl group, cycloalkyl group or cycloalkenyl group of carbon number up to 32, for example methyl, ethyl, propyl, isopropyl, tert-butyl, dodecyl, 2-methanesulfonylethyl, 3-(3-pentadecylphenoxy)propyl, 3-{4-{2-[4-(4-hydroxyphenylsulfonyl)-phenoxy]dodecanamido}phenyl}propyl, 2-ethoxytridecyl, trifluoromethyl, cyclopentyl, 3-(2,4-di-tert-amylphenoxy)propyl), an aryl group (for example, phenyl, 4-tert-butylphenyl, 2,4-di-tert-amylphenyl, 4-tetradecanamidophenyl), a heterocyclic group (for example, 2-furyl, 2-thienyl, 2-pyrimidinyl, 2-benzothiazolyl), a cyano group, a hydroxyl group, a nitro group, a carboxyl group, an amino group, an alkoxy group (for example, methoxy, ethoxy, 2-methoxyethoxy, 2-dodecylethoxy, 2-methanesulfonylethoxy), an aryloxy group (for example, phenoxy, 2-methylphenoxy, 4-tert-butylphenoxy, 3-nitrophenoxy, 3-tert-butyloxycarbamoylphenoxy, 3-methoxycarbamoylphenoxy), an acylamino group (for example, acetamido, benzamido, tetradecanamido, 2-(2,4-di-tert-amylphenoxy)-butanamido, 4-(3-tert-butyl-4-hydroxyphenoxy)-butanamido, 2-{4-(4-hydroxyphenylsulfonyl)phenoxy}dodecanamido), an alkylamino group (for example, methylamino, butylamino, dodecylamino, diethylamino, methylbutylamino), an anilino group (for example, phenylamino, 2-chloroanilino, 2-chloro-5-tetradecanamidoanilino, 2-chloro-5-dodecyloxycarbonylanilino, N-acetylanilino, 2-chloro-5-{α-(3-tert-butyl-4-hydroxyphenoxy)dodecanamido}anilino), a ureido group (for example, phenylureido, methylureido, N,N-dibutylureido), a sulfamoylamino group (for example, N,N-dipropylsulfamoylamino, N-methyl-N-decylsulfamoylamino), an alkylthio group (for example, methylthio, octylthio, tetradecylthio, 2-phenoxyethylthio, 3-phenoxypropylthio, 3-(4-tert-butylphenoxy)propylthio), an arylthio group (for example, phenylthio, 2-butoxy-5-tert-octylphenylthio, 3-pentadecylphenylthio, 2-carboxyphenylthio, 4-tetradecanamidophenylthio), an alkoxycarbonylamino group (for example, methoxycarbonylamino, tetradecyloxycarbonylamino), a sulfonamido group (for example, methanesulfonamido, hexadecanesulfonamido, benzenesulfonamido, p-toluenesulfonamido, octadecanesulfonamido, 2-methyloxy-5-tert-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}carbamoyl), a sulfamoyl group (for example, N-ethylsulfamoyl, N,N-dipropylsulfamoyl, N-(2 -dodecyloxyethyl)sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl), an alkoxycarbonyl group (for example, methoxycarbonyl, butyloxycarbonyl, dodecyloxycarbonyl, octadecyloxycarbonyl), a heterocyclic oxy group (for example, 1-phenyltetrazol-5-oxy group, 2-tetrahydropyranyloxy), an azo group (for example, phenylazo, 4-methoxyphenylazo, 4-pivaloylaminophenylazo, 2-hydroxy-4-propanoylphenylazo), an acyloxy group (for example, acetoxy), a carbamoyloxy group (for example, N-methylcarbamoyloxy, N-phenylcarbamoyloxy), a silyloxy group (for example, trimethylsilyloxy, dibutylmethylsilyloxy), an aryloxycarbonylamino group (for example, phenoxycarbonylamino), an imido group (for example, N-succinimido, N-phthalimido, 3-octadecenylsuccinimido), a heterocyclic thio group (for example, 2-benzothiazolylthio, 2,4-diphenoxy-1,3,5-triazol-6-thio, 2-pyridylthio), a sulfinyl group (for example, dodecanesulfinyl, 3-pentadecylphenylsulfinyl, 3-phenoxypropylsulfinyl), a phosphonyl group (for example, phenoxyphosphonyl, octyloxyphosphonyl, phenylphosphonyl), an aryloxycarbonyl group (for example, phenoxycarbonyl), an acyl group (for example, acetyl, 3-phenylpropanoyl, benzoyl, 4-dodecyloxybenzoyl) or an azolyl group (for example, imidazolyl, pyrazolyl, 3-chloropyrazol-1-yl). The groups among these substituent groups which can have further substituent groups may have halogen atoms or organic substituent groups which are connected to a carbon atom, an oxygen atom, a nitrogen atom or a sulfur atom.

From among these substituent groups, the hydrogen atom, alkyl groups, aryl groups, alkoxy groups, aryloxy groups, alkylthio groups, ureido groups, urethane groups and acylamino groups are preferred for $R_{31}$.

$R_{32}$ is a similar group to the substituent groups indicated for $R_{31}$, and it is preferably a hydrogen atom, an alkyl group, an aryl group, a heterocyclic group, an alkoxycarbonyl group, a carbamoyl group, a sulfamoyl group, a sulfinyl group, an acyl group or a cyano group.

Furthermore, $R_{33}$ is a similar group to the substituent groups indicated for $R_{31}$, and it is preferably a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, and most desirably it is an alkyl group, an aryl group, a heterocyclic group, an alkylthio group or an arylthio group.

A is preferably a group which can be represented by formula (A-1) indicated below.

Formula (A-1)

$$-\{(L_1)_a-(B)_m\}_p-(L_2)_n-DI$$

In this formula, $L_1$ represents a group with which the bond on the right hand side (the bond with $(B)_m$) is cleaved after cleavage of the bond on the left hand side of $L_1$ in formula (A-1), B represents a group which reacts with the oxidized form of a developing agent and with which the bond on the right hand side of B shown in formula (A-1) is cleaved, $L_2$ represents a group with which the bond on the right hand side (the bond with DI) is cleaved after cleavage of the bond on the left hand side of $L_2$ in formula (A-1), DI represents a development inhibitor, a, m and n each represent 0 or 1, and p represents an integer of 0 to 2. Here, the p individual $(L_1)_a-(B)_m$ moieties may be the same or different when p is a plural number.

The course of the reaction by which compounds having a group represented by the formula (A-1) release DI during development can be represented by the following reaction equations. An example of a case in which p=1 is illustrated here.

$$E-(L_1)_a-(B)_m-(L_2)_n-DI \xrightarrow{DQI^+}$$

$$(L_1)_a-(B)_m-(L_2)_n-DI \longrightarrow (B)_m-(L_2)_n-DI \xrightarrow{DQI^+}$$

$$(L_2)_n-DI \longrightarrow DI$$

In these equations, $L_1$, a, B, m, $L_2$, n and DI have the same significance as described in connection with formula (A-1), and $DQI^+$ signifies the oxidized form of a developing agent. E represents a pyrazoloazole magenta coupler residual group as described earlier, which is to say the part other than A of formula (II).

In formula (A-1), the linking groups represented by $L_1$ and $L_2$ may be, for example, groups which utilize a hemiacetal cleavage reaction as disclosed in U.S. Pat. Nos. 4,146,396, 4,652,516 and 4,698,297, timing groups with which a cleavage reaction occurs utilizing an intramolecular nucleophilic reaction as disclosed in U.S. Pat. No. 4,248,962, timing groups with which a cleavage reaction occurs utilizing an electron transfer reaction as disclosed in U.S. Pat. Nos. 4,409,323 and 4,421,845, a group with which a cleavage reaction occurs utilizing the hydrolysis reaction of an iminoketal as disclosed in U.S. Pat. No. 4,546,073, or a group with which a cleavage reaction occurs utilizing the hydrolysis reaction of an ester as disclosed in West German Patent (laid open) 2,626,317. $L_1$ and $L_2$ are each linked to E or $E-(L_1)_a-(B)_m$ at a hetero atom, and preferably an oxygen atom, a sulfur atom or a nitrogen atom, which is included therein.

Groups which are preferred when the groups represented by $L_1$ and $L_2$ are used are indicated below.

(1) Groups which Utilize a Hemi-acetal Cleavage Reaction

Examples are disclosed in U.S. Pat. No. 4,146,396, JP-A-60-249148 and JP-A-60-249149, and these groups can be represented by the formula (T-1) indicated below, where * indicates the bond to the left hand side of $L_1$ or $L_2$ in the group represented by formula (A-1) and ** indicates the bond on the right hand side of $L_1$ or $L_2$ in the group which is represented by formula (A-1).

Formula (T-1)

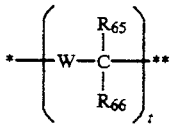

In this formula, W represents an oxygen atom, a sulfur atom or an —$NR_{67}$— group, $R_{65}$ and $R_{66}$ each represent hydrogen atoms or substituent groups, $R_{67}$ represents a substituent group and t represents 1 or 2. When t is 2, the two —W—$CR_{65}(R_{66})$— groups may be the same or different. Typical examples of $R_{65}$ and $R_{66}$, when they represent substituent groups, and $R_{67}$, include the $R_{69}$, $R_{69}CO$—, $R_{69}SO_2$—, $R_{69}NR_{70}CO$— and $R_{69}NR_{70}SO_2$— groups. Here, $R_{69}$ represents an aliphatic group, an aromatic group or a heterocyclic group, and $R_{70}$ represents an aliphatic group, an aromatic group, a heterocyclic group or a hydrogen atom. Cases in which $R_{65}$, $R_{66}$ and $R_{67}$ respectively represent divalent groups which are joined together to form ring structures are also included. Actual examples of groups represented by the formula (T-1) are indicated below.

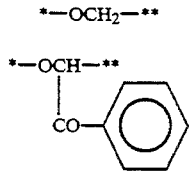

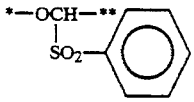

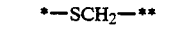

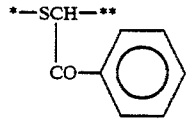

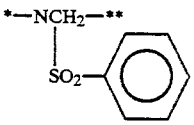

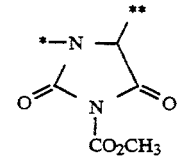

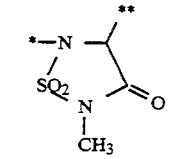

(2) Groups with which a Cleavage Reaction Occurs Utilizing an Intramolecular Nucleophilic Substitution Reaction For example, the timing groups disclosed in U.S. Pat. No. 4,248,962 may be cited. These can be represented by formula (T-2) indicated below.

Formula (T-2)

* -Nu-Link-G- **

In this formula, * and  have the same significance as described in connection with formula (T-1). Nu represents a nucleophilic group. The nucleophilic species is an oxygen atom or a sulfur atom, for example. G represents an electrophilic group, being the group which is the subject of a nucleophilic attack by Nu so that the bond marked  can be cleaved. Link represents a linking group which enables Nu and G to have a steric arrangement such that an intramolecular nucleophilic substitution reaction can occur. Actual examples of the groups represented by formula (T-2) are indicated below.

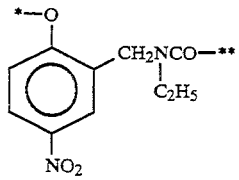

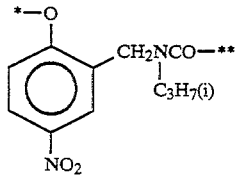

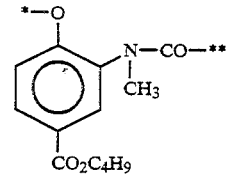

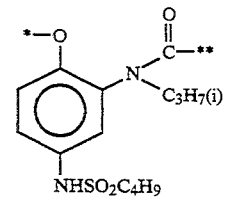

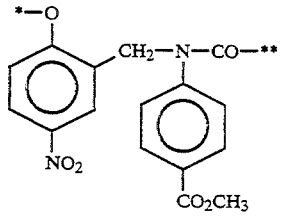

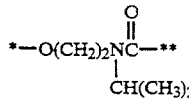

-continued

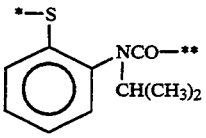

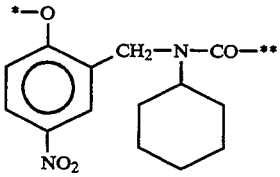

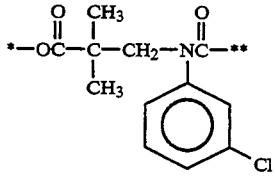

(3) Groups with which a Cleavage Reaction Occurs Utilizing an Electron Transfer Reaction along a Conjugated System For example, groups represented by the formula (T-3) indicated below which are disclosed in U.S. Pat. Nos. 4,409,323 and 4,421,845 may be cited.

Formula (T-3)

$$*-W-(V_1=V_2)_t-CH_2-**$$

In this formula, $V_1$ and $V_2$ represent $=CR_{65}-$ or nitrogen atom. Moreover, *, **, W, $R_{65}$, and t have the same significance as described in connection with formula (T-1). Actual examples of these groups are indicated below.

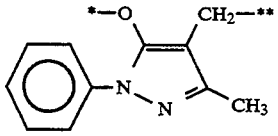

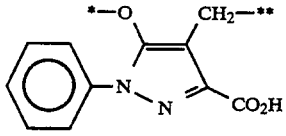

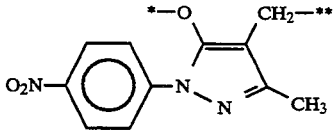

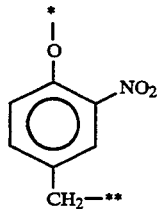

-continued

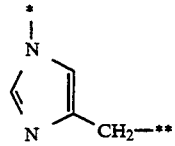

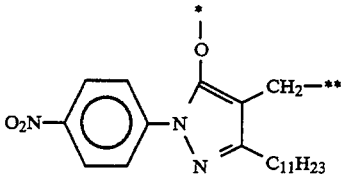

(4) Groups with which a Cleavage Reaction due to Ester Hydrolysis is Utilized

For example, the linking groups disclosed in West German Patent Laid Open No. 2,626,315 and the groups which are represented by general formulae (T-4) and (T-5) indicated below may be cited. In these formulae, * and ** have the same significance as described in connection with formula (T-1).

Formula (T-4)

$$*-O-CO-**$$

Formula (T-5)

$$*-S-CS-**$$

(5) Groups with which an Iminoketal Cleavage Reaction is Utilized

For example, the linking groups disclosed in U.S. Pat. No. 4,546,073 and the groups which are represented by the formula (T-6) indicated below may be cited.

Formula (T-6)

$$*-W-C(=NR_{68})-**$$

In this formula, *, ** and W have the same significance as described in connection with formula (T-1), and $R_{68}$ has the same significance as $R_{67}$. Actual examples of groups represented by formula (T-6) are indicated below.

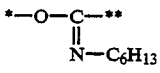

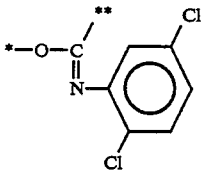

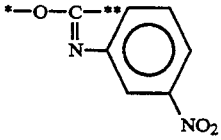

-continued

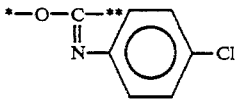

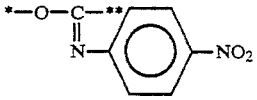

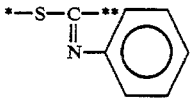

The group represented by B in the aforementioned formula (A-1) is, more precisely, represented by the formula (B-1), (B-2), (B-3) or (B-4) indicated below.

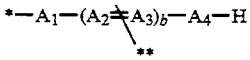

(B-1)

In this formula, * indicates the position which is bonded on the left hand side of B in formula (A-1), and  indicates the position which is bonded on the right hand side of B in formula (A-1). $A_1$ and $A_4$ each represent an oxygen atom or —N—($SO_2R_{71}$)— (where $R_{71}$ represents an aliphatic group, an aromatic group or a heterocyclic group), $A_2$ and $A_3$ each represent a methine group or a nitrogen atom, and b represents an integer of from 1 to 3. However, at least one of the b $A_2$ groups and b $A_3$ groups represents a methine group which has a bond as shown by . Furthermore, when b is a plural number, the b $A_2$ groups and b $A_3$ groups may be the same or different. When $A_2$ and $A_3$ are methine groups which have substituent groups, these include those cases in which these groups are joined together to form ring structures (for example, a benzene ring or a pyridine ring), and cases where this is not so. The groups represented by formula (B-1) form compounds to which the Kendall-Pelz rule applies (see T. H. James, "*The Theory of the Photographic Process*", 4th Edition, Macmillan Publishing Co., Inc., page 299) after cleavage of the * bond, and oxidation occurs by reaction with the oxidized form of a developing agent.

Actual examples of groups which can be represented by formula (B-1) are indicated below.

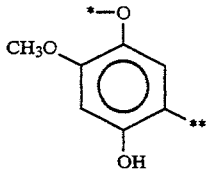

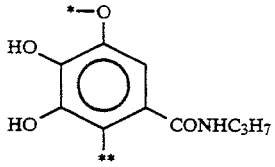

-continued

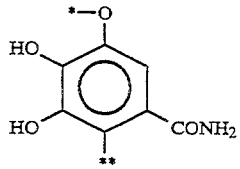

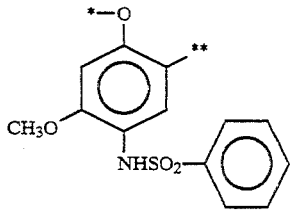

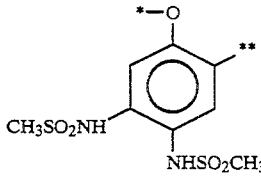

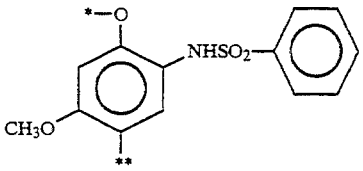

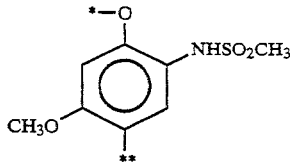

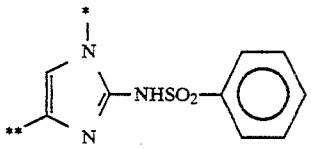

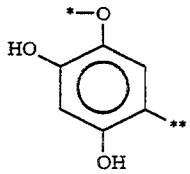

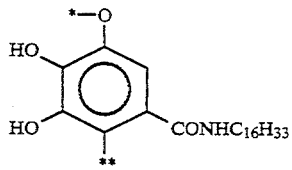

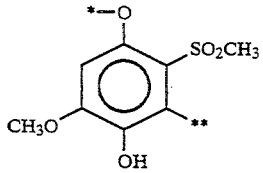

-continued (B-2)

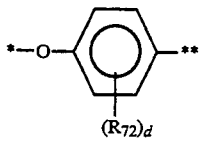

(B-3)

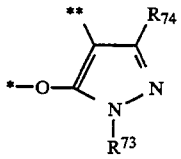

In these formulae, * and  have the same significance as described in connection with formula (B-1), and $R_{72}$, $R_{73}$ and $R_{74}$ are groups which enable the groups represented by formulas (B-2) and (B-3) to function as couplers which have a coupling leaving group at  after cleavage at *. Moreover, d represents an integer of from 0 to 4, and when d is a plural number the plurality of $R_{72}$ groups may be the same or different. Furthermore, these may be joined to form ring structures (for example, a benzene ring). $R_{72}$ may be, for example, an acylamino group, an alkyl group or a halogen atom, $R_{74}$ may be, for example, an acylamino group, an alkyl group, an anilino group, an amino group or an alkoxy group, and $R_{73}$ may be, for example, a phenyl group or an alkyl group.

Actual examples of groups represented by formulas (B-2) and (B-3) are indicated below.

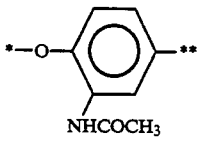

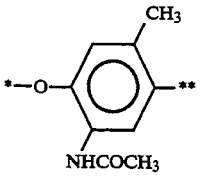

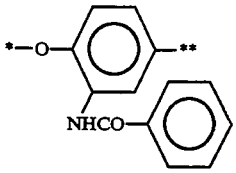

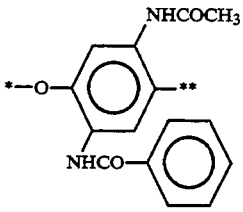

-continued

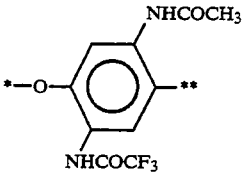

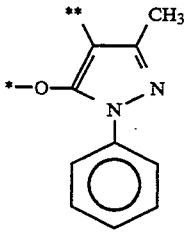

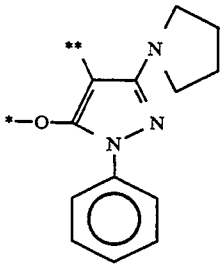

(B-4)

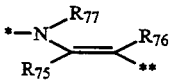

In this formula * and  have the same significance as described in connection with formula (B-1), $R_{75}$, $R_{76}$ and $R_{77}$ each represent a substituent group, and cases where $R_{77}$ and $R_{76}$ are joined together to form a nitrogen containing heterocyclic ring and cases where $R_{77}$ and $R_{75}$ are joined together to form a nitrogen-containing heterocyclic ring are both included. The group shown by formula (B-4) forms a coupler which has a coupling leaving group at  after cleavage at *.

Actual examples of groups which can be represented by formula (B-4) are indicated below.

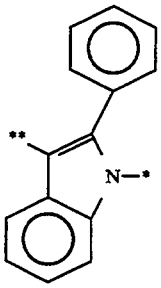

-continued

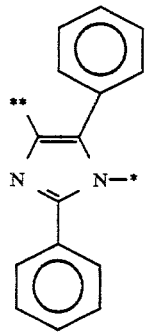

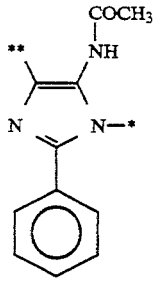

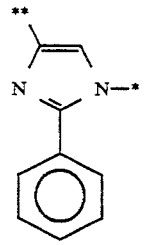

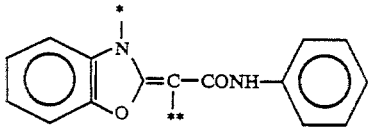

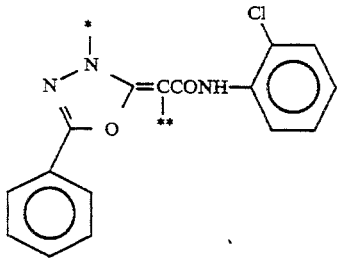

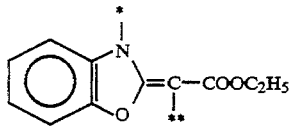

The group represented by DI in formula (A-1) described above is, for example, a tetrazolylthio group, a thiadiazolylthio group, an oxadiazolylthio group, a triazolylthio group, a benzimidazolylthio group, a benzthiazolylthio group, a tetrazolylseleno group, a benzoxazolylthio group, a benzotriazolyl group, a triazolyl group or a benzimidazolyl group. These groups have been disclosed, for example, in U.S. Pat. Nos. 3,227,554, 3,384,657, 3,615,506, 3,617,291, 3,733,201, 3,933,500, 3,958,993, 3,961,959, 4,149,886, 4,259,437, 4,095,984, 4,477,563 and 4,782,012, and British Patent 1,450,479.

Actual examples of groups represented by DI are indicated below. In these formulae * represents the position which is bonded on the left hand side of the group shown by DI in formula (A-1).

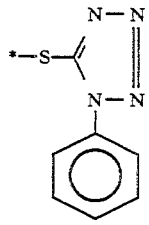

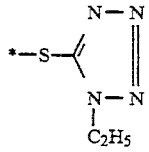

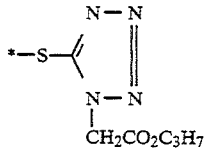

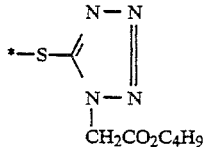

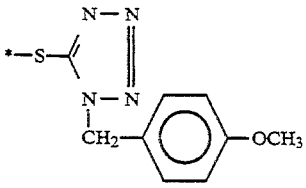

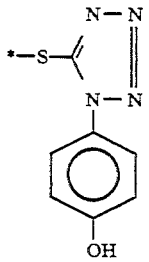

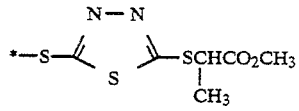

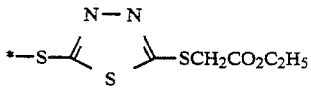

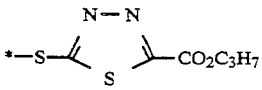

-continued

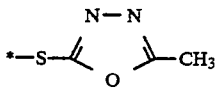

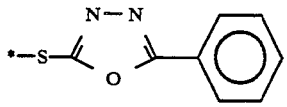

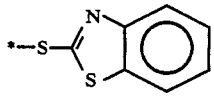

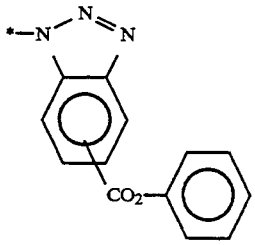

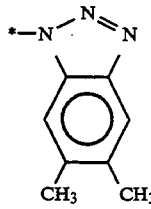

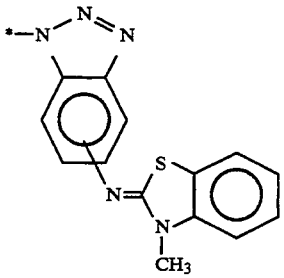

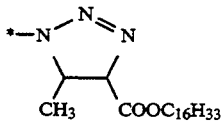

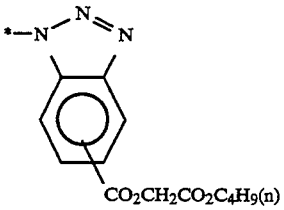

From among the groups represented by formula (A-1), those which can be represented by the formulae (A-2), (A-3) and (A-4) indicated below are especially desirable.

Formula (A-2)

$$-(L_1)-B-DI$$

Formula (A-3)

$$-(L_2)-DI$$

Formula (A-4)

$$-DI$$

In these formulae, $L_1$, $L_2$, B and DI have the same significance as $L_1$, $L_2$, B and DI in formula (A-1).

In those cases where A is a group which is eliminated at an oxygen atom in a compound represented by formula (II) in this present invention, $R_{23}$ is preferably a hydrogen atom, an alkyl group or an aryl group from the point of view of the rate of the coupling reaction with the oxidized form of the developing agent, and in those cases where A is eliminated with a group which can be represented by formula (B-1), the presence of a substituent group of which the Hammett $\sigma_p$ value is at least 0.3 in the leaving group is especially desirable for increasing storage stability in a sensitive material.

Substituent groups of which the Hammett $\sigma_p$ value is at least 0.3 include halogenated alkyl groups (for example, trichloromethyl, trifluoromethyl, heptafluoropropyl), cyano group, acyl groups (for example, formyl, acetyl, benzoyl), alkoxycarbonyl groups (for example, methoxycarbonyl, propoxycarbonyl), aryloxycarbonyl groups (for example, phenoxycarbonyl), carbamoyl groups (for example, N-methylcarbamoyl, N-propylcarbamoyl), sulfamoyl groups (for example N,N-dimethylsulfamoyl), sulfonyl groups (for example, methanesulfonyl, benzenesulfonyl), thiocyanato group, nitro group, phosphinyl groups (for example, diethylphosphinyl, dimethylphosphinyl) and heterocyclic groups (for example, 1-pyrrolyl, 2-benzoxazolyl).

Actual examples of groups of which the Hammett $\sigma_p$ value is at least 0.3 are shown below, but the invention is not limited by these examples. Moreover, the numerical value shown in brackets is the $\sigma_p$ value. The $\sigma_p$ value is cited from *Structure/Activity Correlation for Reagents,* Kagaku no Ryochi Zokan No. 122, Nanedo).

| | | | |
|---|---|---|---|
| $-CO_2C_2H_5$ | (0.45), | $-CONHCH_3$ | (0.36), |
| $-CF_2CF_2CF_2CF_3$ | (0.52), | $-C_6H_5$ | (0.41), |
| $-COCH_3$ | (0.50), | $-COC_6H_5$ | (0.43), |
| $-P(O)(OCH_3)_2$ | (0.53), | $-SO_2NH_2$ | (0.57), |
| $-SCN$ | (0.52), | $-CO_2C_6H_5$ | (0.44), |
| $-CO_2CH_3$ | (0.45), | $-CONH_2$ | (0.36), |
| $-(CF_2)_3CF_3$ | (0.52), | $-CN$ | (0.66) |

Furthermore, in those cases where A is a group which is eliminated at a nitrogen atom or sulfur atom in the compound represented by formula (II), $R_{23}$ is preferably an alkoxy group or an aryloxy group and, moreover, the presence of a hydrogen atom, an alkyl group, an aryl group or a heterocyclic group as a substituent group for the azole ring part represented by Z is especially desirable from the viewpoint of storage stability in a sensitive material, and the presence of an aryl group is especially desirable.

Among the compounds which can be represented by the formulas (P-1), (P-2), (P-3) and (P-4) described already as preferred for formula (II), those represented by formulas (P-1), (P-2) and (P-3) are preferred from the viewpoint of the hue of the magenta dye which is formed, and those represented by formulas (P-2) and (P-3) are especially desirable.

Furthermore, the compounds represented by formula (II) may form dimers or oligomers via divalent groups or groups of valency more than two among the substituent groups $R_{23}$ or the substituent groups of the azole ring represented by Z.

In those cases where the compound represented by formula (II) forms an oligomer, it is typically a homopolymer or a copolymer of an addition polymerizable ethylenically unsaturated compound which has the aforementioned compound as a residual group (a color forming monomer). In this case the oligomer contains a repeating unit of the formula (V) indicated below. One type of color forming repeating unit may be included in the oligomer, or the oligomer may be a copolymer which contains one or more types of non-color forming ethylenic monomer as a copolymer unit.

Formula (V)

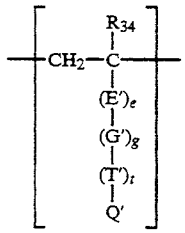

In this formula, $R_{34}$ represents a hydrogen atom, an alkyl group of carbon number 1 to 4 or a chlorine atom, E' represents —CONH—, —$CO_2$— or a substituted or unsubstituted phenylene group, G' represents a substituted or unsubstituted alkylene group, phenylene group or aralkylene group, and T' represents —CONH—, —NHCONH—, —$NHCO_2$—, —NHCO—, —OCONH—, —NH—, —$CO_2$—, —OCO—, —CO—, —O—, —$SO_2$—, —$NHSO_2$— or —$SO_2NH$—. Moreover, e, g and t represent 0 or 1, but e, g and t cannot all be 0 at the same time. Q' represents a compound residual group in which a hydrogen atom has been eliminated from a compound which can be represented by formula (I).

Copolymers of monomers which provide a unit of formula (V) and non-color forming ethylenic monomers as indicated below are preferred for the oligomers.

Thus, non-color forming ethylenic monomers which do not couple with the oxidized form of a primary aromatic amine developing agent include acrylic acid, α-chloroacrylic acid, α-alkylacrylic acids (for example, methacrylic acid), esters and amides derived from these acrylic acids (for example, acrylamide, methacrylamide, n-butylacrylamide, tert-butylacrylamide, diacetoneacrylamide, methylene-bis-acrylamide, methyl acrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxymethacrylate), vinyl esters (for example, vinyl acetate, vinyl propionate and vinyl laurate), acrylonitrile, methacrylonitrile, aromatic vinyl compounds (for example, styrene and derivatives thereof, such as vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid esters, N-vinyl-2-pyrrolidone and N-vinylpyridine.

The acrylic acid esters, methacrylic acid esters and maleic acid esters are especially desirable. Two or more of the non-color forming ethylenic monomers used here can be used conjointly. For example, methyl acrylate and butyl acrylate, butyl acrylate and styrene, butyl methacrylate and methacrylic acid, and methyl acrylate and diacetoneacrylamide can be used.

In cases where a polymeric coupler which contains repeating units which can be represented by the aforementioned formula (V) are prepared, as is well known in the field of polymeric couplers, the non-color forming ethylenic monomer which is copolymerized with the ethylenic monomer which has a coupler residual group of this present invention can be selected in such a way as to favorably affect the physical and/or chemical properties of the copolymer which is formed, which is to say in such a way as to favorably affect the solubility, the compatibility with binding agents, such as gelatin for example, of photographic colloid compositions, the plasticity or the thermal stability, for example.

The polymer compounds which can be used in the present invention (lipophilic polymer compounds in which vinyl based monomers which provide units represented by the aforementioned formula (V) have been polymerized) may be dissolved in an organic solvent and emulsified and dispersed in the form of a latex in an aqueous gelatin solution, or the direct emulsion polymerization method can be used. The method disclosed in U.S. Pat. No. 3,451,820 can be used to form an emulsified dispersion in the form of a latex in an aqueous gelatin solution of a lipophilic polymer compound, and the methods disclosed in U.S. Pat. Nos. 4,080,211 and 3,370,952 can be used for emulsion polymerization.

The development inhibitor releasing compound represented by formula (II) of the present invention can be synthesized by the methods described in, for example, U.S. Pat. Nos. 4,500,630, 4,540,654, 4,705,863, 3,725,067 and 4,659,952, European Patent 0501468, and JP-A-61-65245, 62-209457, 62-249155, 60-33552, 61-28947, 63-58415, and 2-59584.

Actual examples of compounds represented by formula (II) which can be used in the present invention are indicated below, but the invention is not limited by these examples.

(1)
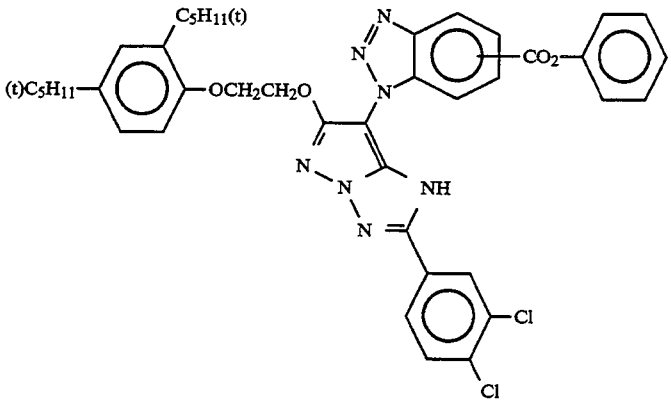
(2)
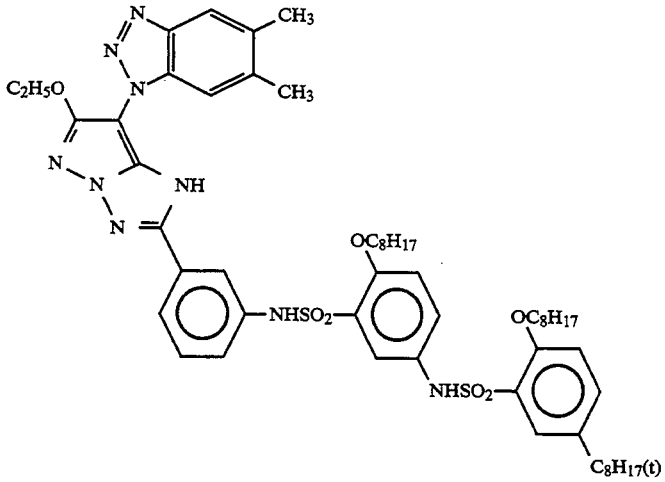
(3)
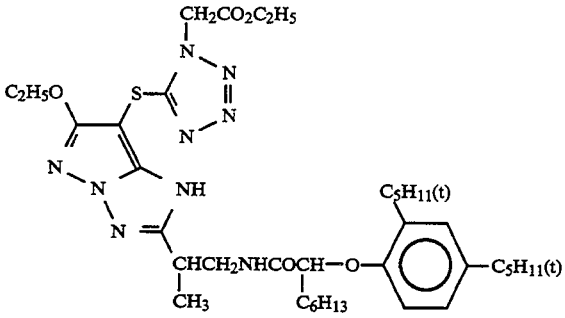
(4)
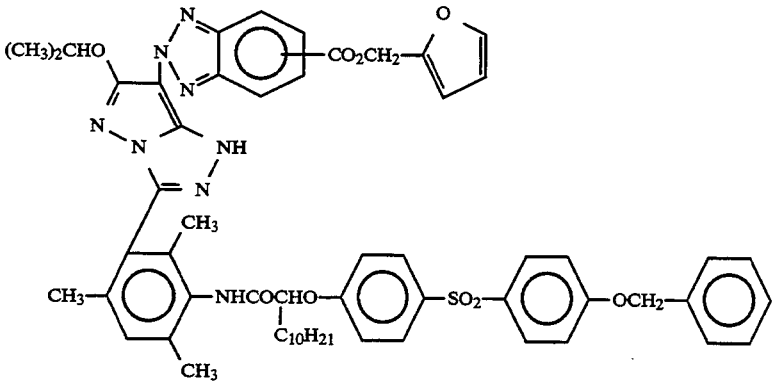

-continued
(5)
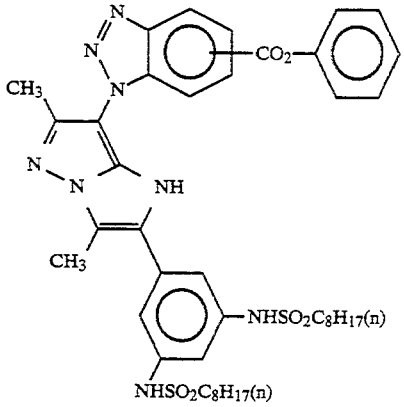
(6)
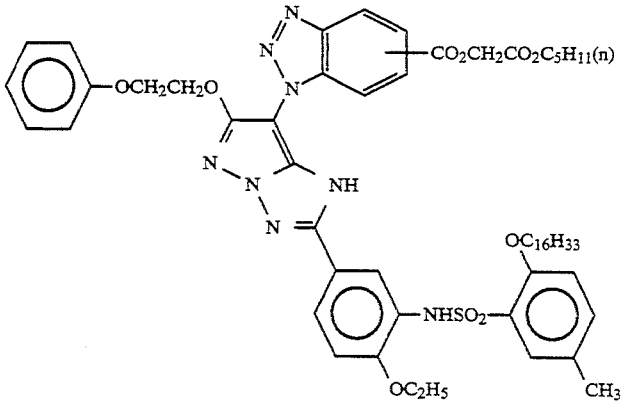
(7)
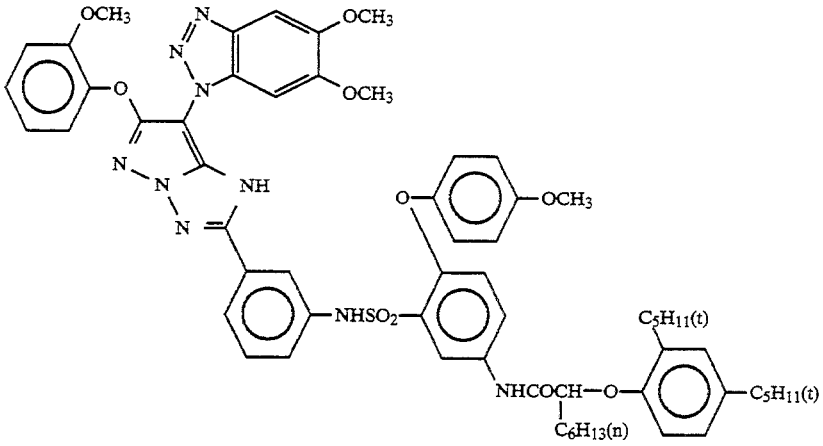
(8)
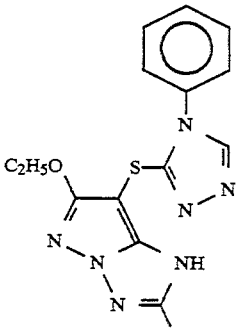

-continued
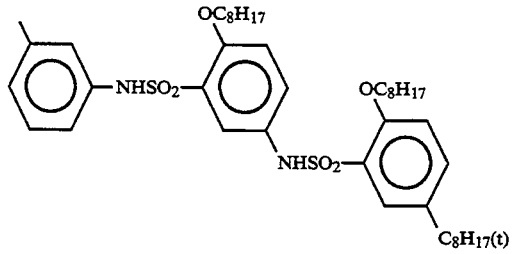
(9)
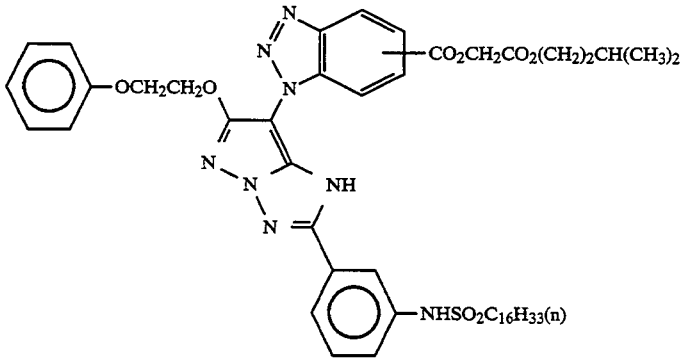
(10)
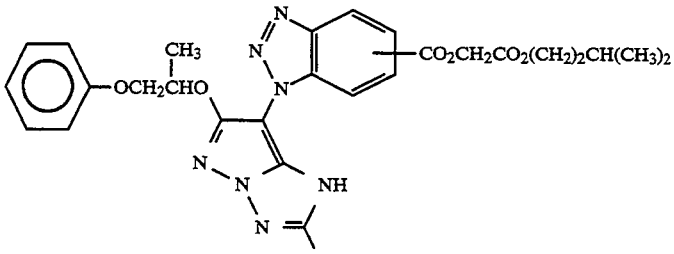
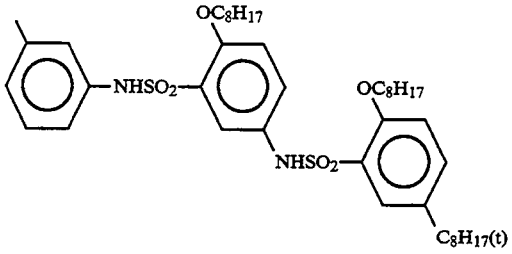
(11)
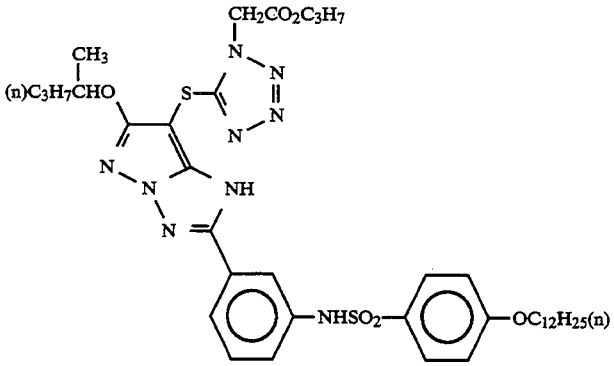

-continued
(12)
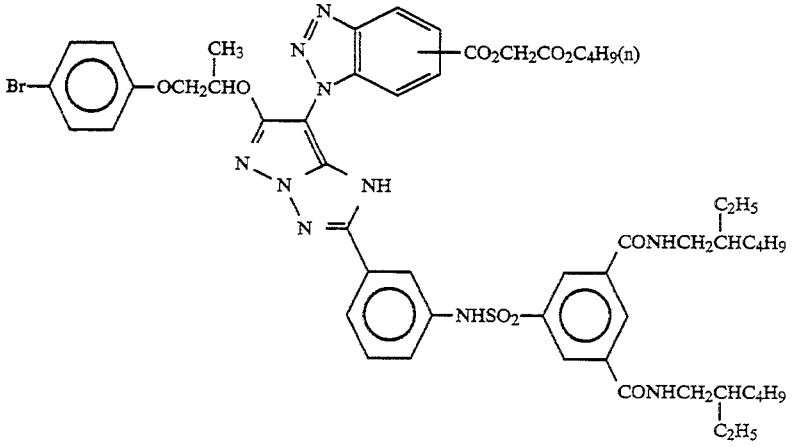
(13)
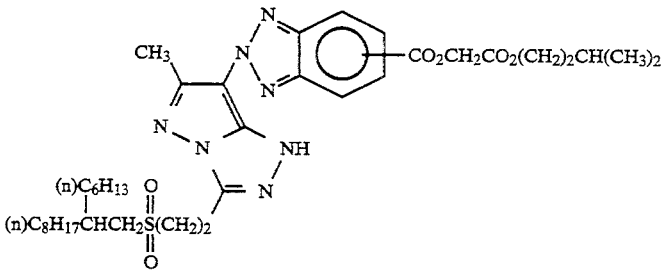
(14)
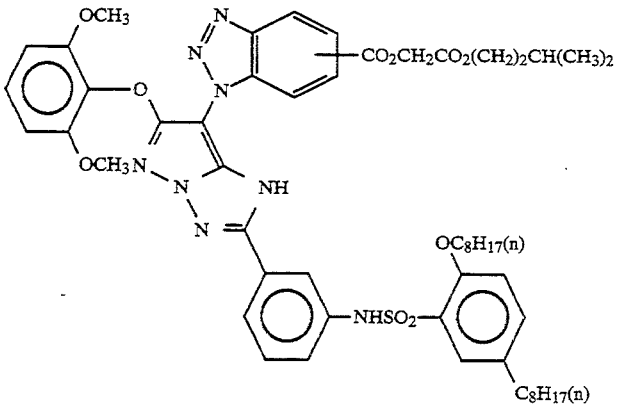
(15)
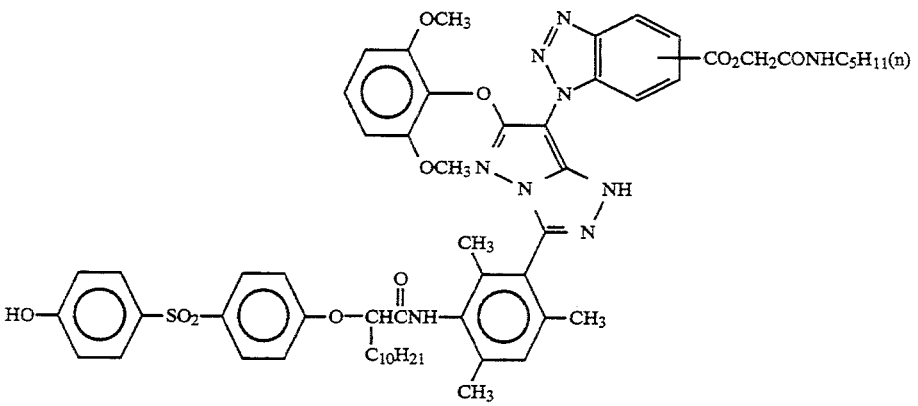

-continued
(16)
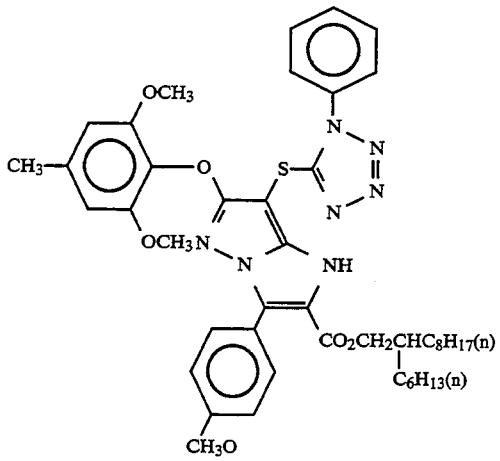
(17)
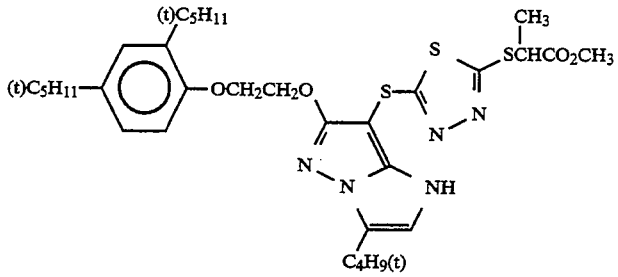
(18)
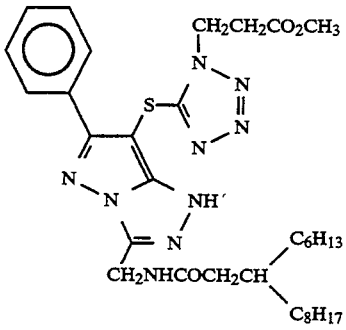
(19)
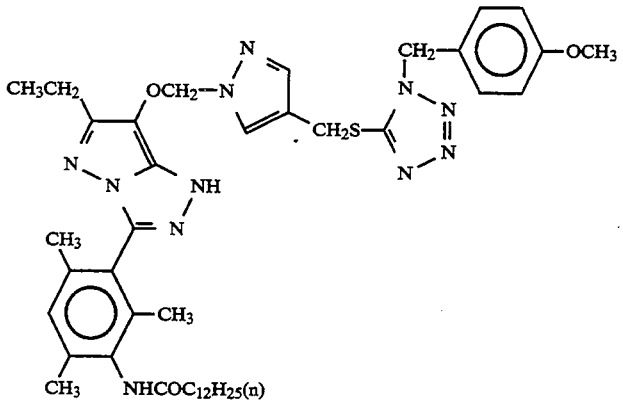

-continued
(20)
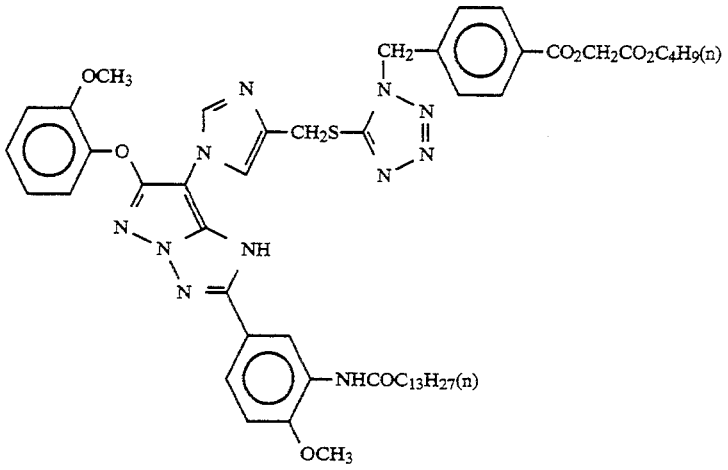
(21)
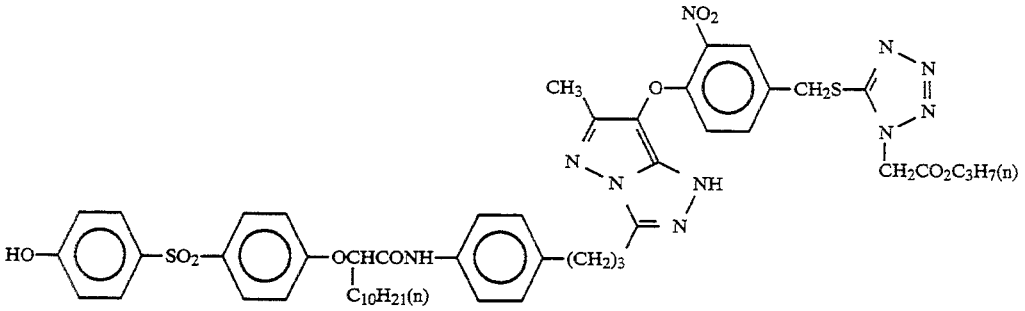
(22)
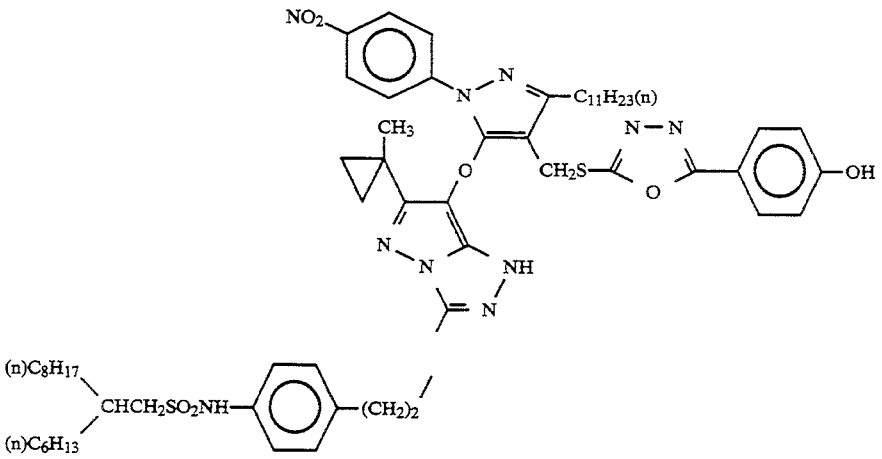
(23)
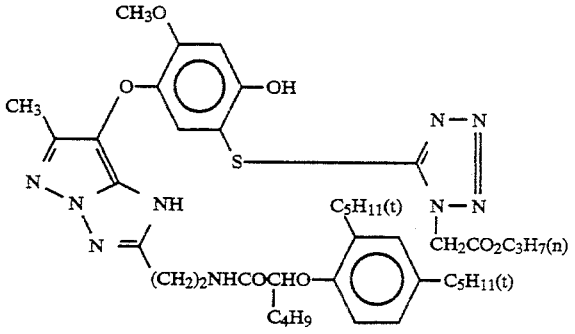

-continued
(24)
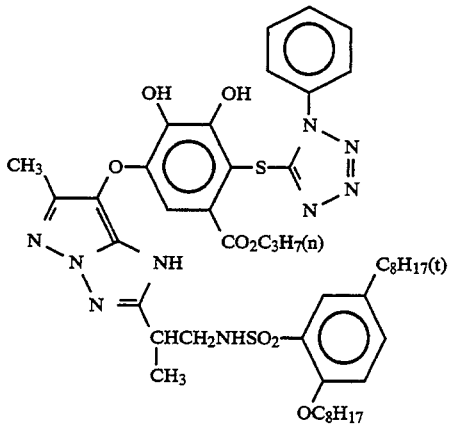
(25)
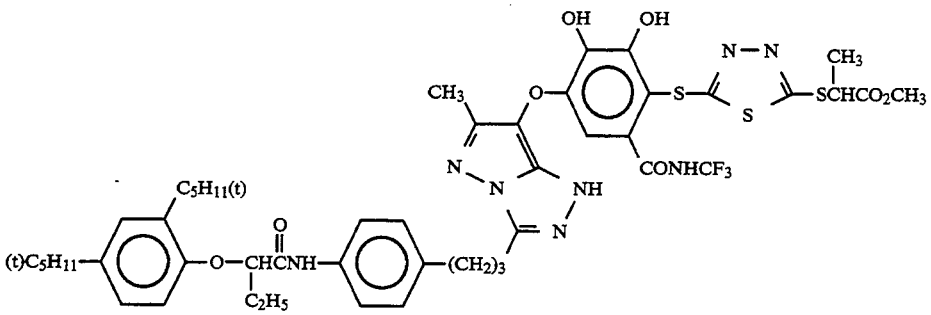
(26)
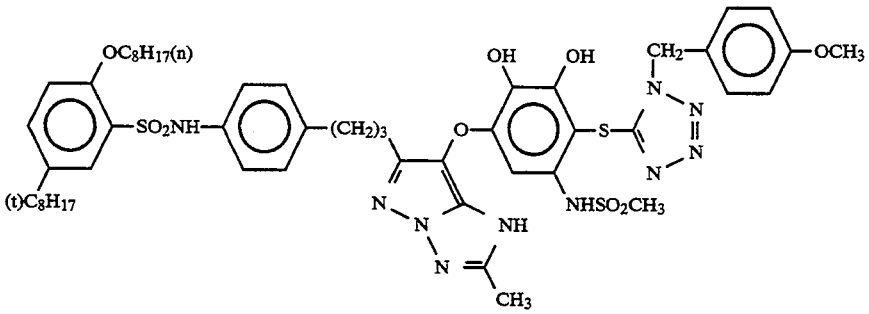
(27)
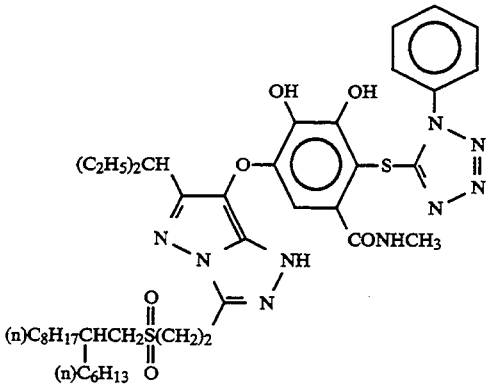

-continued
(28)
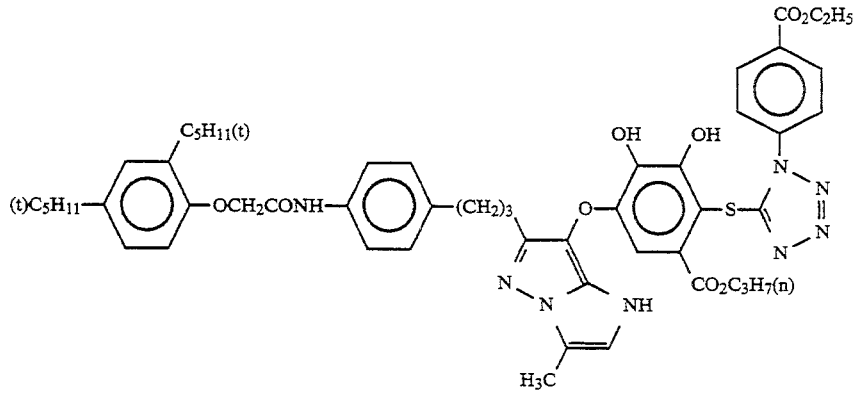
(29)
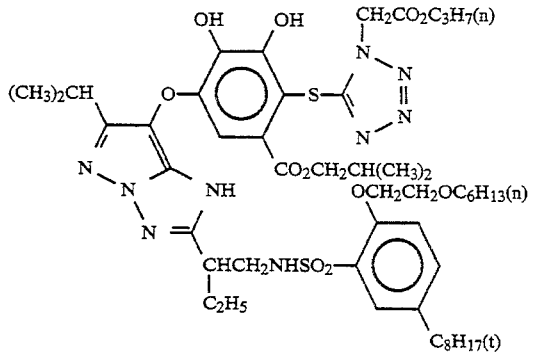
(30)
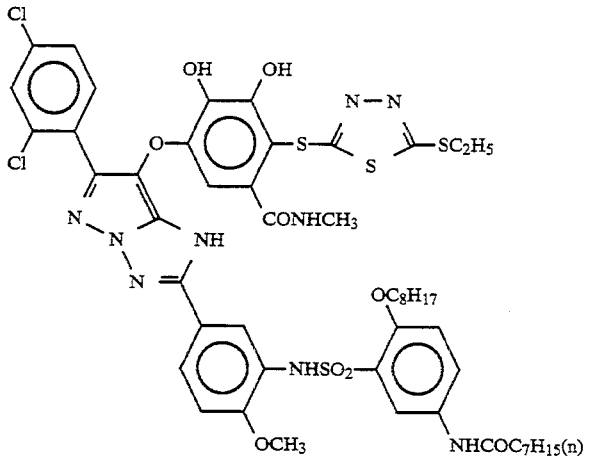
(31)
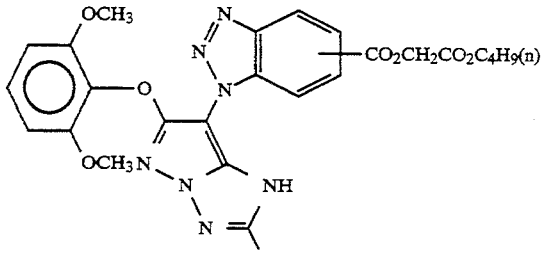

-continued

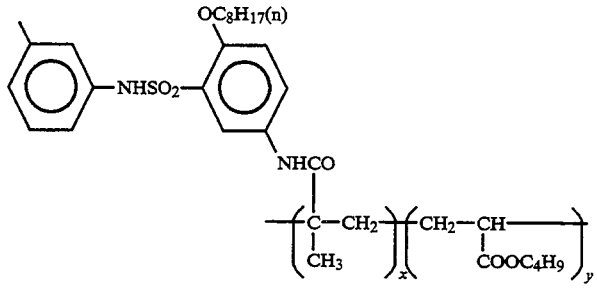

x:y = 50:50 (molar ratio)

(32)

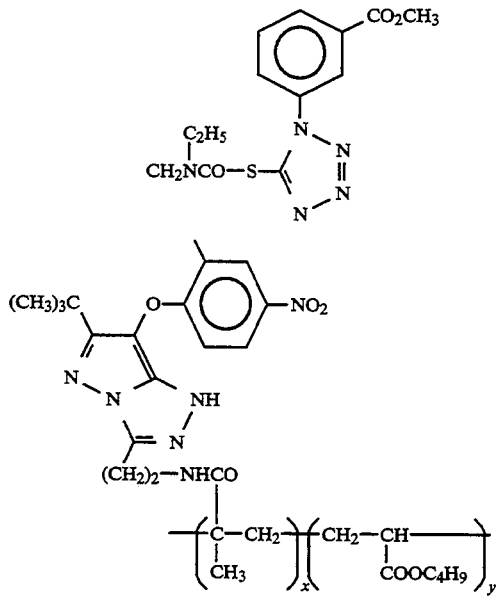

x:y = 50:50 (molar ratio)

The development inhibitor releasing compound of formula (II) is preferably contained in an amount of 0.01 to 0.85 g/m$^2$ of the color photosensitive material of the present invention.

The preferred silver halides for inclusion in the photographic emulsion layers of a photographic photosensitive material of the present invention are silver iodobromides, silver iodochlorides or silver iodochlorobromides which contain not more than about 30 mol % of silver iodide. Silver iodobromides or silver iodochlorobromides which contain from about 2 mol % to about 10 mol % of silver iodide are especially desirable.

The silver halide grains in the photographic emulsions may have a regular crystalline form such as a cubic, octahedral or tetradecahedral form, an irregular crystalline form such as a spherical or plate-like form, a form which has crystal defects such as twinned crystal planes for example, or a form which is a composite of these forms.

The grain size of the silver halide may be fine at less than about 0.2 microns, or the grain size may be large with projected area diameters of up to about 10 microns, and the emulsions may be poly-disperse emulsions or mono-disperse emulsions.

Silver halide photographic emulsions which can be used in this present invention can be prepared, for example, using the methods disclosed in *Research Disclosure* (RD) No. 17643 (December, 1978), pages 22 to 23, "I. Emulsion Preparation and Types", *Research Disclosure* No. 18716 (November, 1979), page 648 and *Research Disclosure,* No. 307105 (November, 1989), pages 863 to 865, and the methods described by P. Glafkides in *Chimie et Physique Photographique,* published by Paul Montel, 1967, by G. F. Duffin in *Photographic Emulsion Chemistry,* published by Focal Press, 1966, and by V. L. Zelikman et al. in *Making and Coating Photographic Emulsion,* published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains of a type such that the aspect ratio is at least about 3 can also be used in this present invention. Tabular grains can be prepared easily using the methods described, for example, by Gutoff in *Photographic Science and Engineering,* Volume 14, pages 248 to 257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure. Furthermore, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above-mentioned emulsions may be of the surface latent image type with which the latent image is formed principally on the surface, of the internal latent image type in which the latent image is formed within the grains, or of a type with which the latent image is formed both at the surface and within the grains, but a negative type emulsion is essential. From among the internal latent image types, the emulsion may be a core/shell internal latent image type emulsion as disclosed in JP-A-63-264740. A method for the preparation of a core/shell internal latent image type emulsion has been disclosed in JP-A-59-133542. The thickness of the shell of the emulsion differs according to the development processing for example, but it is preferably from 3 to 40 nm, and most desirably from 5 to 20 nm.

The silver halide emulsions which are used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

| Type of Additive | RD17643 | RD18716 | D307105 |
|---|---|---|---|
| 1. Chemical Sensitizers | Page 23 | Page 648, right hand column | Page 866 |
| 2. Speed Increasing Agents | — | Page 648, right hand column | |
| 3. Spectral Sensitizers, Super-Sensitizers | Pages 23–24 | Page 648 right hand column - page 649 right hand column | Pages 866–868 |
| 4. Bleaching Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultraviolet absorbers | Pages 25–26 | Page 649, right hand column - page 650, left hand column | Page 873 |
| 7. Anti-staining Agents | Page 25, right hand column | Page 650, left hand column - right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors, Surfactants | Pages 26–27 | Page 650, right hand column | Pages 875–876 |
| 13. Anti-static agents | Page 27 | Page 650, right hand column | Pages 876–877 |
| 14. Matting Agents | — | — | Pages 878–879 |

The effects are more readily realized in cases where a silver halide color photographic photosensitive material of the present invention is used in a lens-fitted film unit as disclosed in JP-B-2-32615 and JP-B-U-3-39784. (The term "JP-B" as used herein signifies an "examined Japanese patent publication", and the term "JP-B-U" as used herein signifies an "examined Japanese utility model publication".)

The invention is described in more detail below by means of illustrative examples, but the invention is not limited by these examples.

EXAMPLE 1

1.Preparation of Emulsions

Emulsions A to D which had different grain sizes were prepared using the controlled double jet method.

Emulsion A: (Corresponding sphere diameter 0.70 μm, variation coefficient of the corresponding sphere diameter 25%, AgI 5.0 mol %, tabular multi-layer structure grains, diameter/thickness ratio 6.0)

Emulsion B: (Corresponding sphere diameter 0.65 μm, otherwise the same specification as for emulsion A)

Emulsion C: (Corresponding sphere diameter 0.62 μm, otherwise the same specification as for emulsion A)

Emulsion D: (Corresponding sphere diameter 0.59 μm, otherwise the same specification as for emulsion A)

Emulsions (1) to (7), which had been subjected to gold sensitization, sulfur sensitization and selenium sensitization in the presence of the spectrally sensitizing dyes shown in Table 1 and sodium thiocyanate, were prepared with emulsions A to D in accordance with the example described in JP-A-3-237450.

The emulsions obtained were coated onto a triacetylcellulose support and evaluated using the method disclosed in Example 1 of Japanese Patent Application No. 4-78927.

The photographic speeds of the emulsions obtained are indicated by the relative value of the reciprocals of the exposures required to give an optical density of fog +0.1. The results are shown in Table 1.

TABLE 1

| Emulsion | Emulsion Used | Sensitizing Dye (Amount Used mol/mol · Ag) | Photographic Speed |
|---|---|---|---|
| (1) | A | ExS-3*1 ($6.2 \times 10^{-4}$) | 100 |
| (2) | A | ExS-9*2 ($7.0 \times 10^{-4}$) | 99 |
| (3) | B | I-1 ($7.0 \times 10^{-4}$) | 100 |
| (4) | B | I-2 ($7.0 \times 10^{-4}$) | 100 |

TABLE 1-continued

| Emulsion | Emulsion Used | Sensitizing Dye (Amount Used mol/mol · Ag) | Photographic Speed |
|---|---|---|---|
| (5) | A | ExS-9*2 ($6.8 \times 10^{-4}$)<br>ExS-4*1 ($1.0 \times 10^{-4}$) | 101 |
| (6) | C | I-2 ($6.8 \times 10^{-4}$)<br>ExS-4*1 ($1.0 \times 10^{-4}$) | 101 |
| (7) | D | I-1 ($6.8 \times 10^{-4}$)<br>ExS-5*1 ($1.0 \times 10^{-4}$) | 100 |

Note
*1The sensitizing dyes EXS-3, -4 and -5 are the same as those described in Examples 2 below.
*2The sensitizing dye EXS-9 has the following structure.

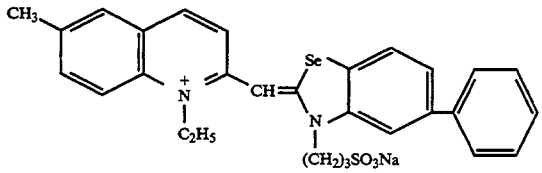

It is clear from Table 1 that the emulsions (1) to (7) obtained all had more or less the same photographic speed.

EXAMPLE 2

Sample 101, a multi-layer color photosensitive material comprised of layers having the compositions are indicated below, was prepared on a cellulose triacetate film support on which an under-layer had been established.

Composition of the Photosensitive Layer

The coated weights in the case of silver halides and colloidal silver are indicated in units of g/m² of silver, the coated weights of couplers, additives and gelatin are indicated in units of g/m², and the coated weights of sensitizing dyes are indicated in units of mol per mol of silver halide in the same layer. Moreover, the symbols used to indicate additives have the significance indicated below. However, cases where an additive has a plurality of effects are noted typically under just one of those effects.

UV: Ultraviolet absorber, Solv: High boiling point organic solvent, ExF: Dye, ExS: Sensitizing dye, ExC: Cyan coupler, ExM: Magenta coupler, ExY: Yellow coupler, Cpd: Additive

| | |
|---|---|
| First Layer (Anti-halation Layer) | |
| Black colloidal silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-3 | $1.0 \times 10^{-3}$ |
| Second Layer | |
| (Low Speed Red Sensitive Emulsion Layer) | |
| Silver iodobromide emulsion (AgI 4.0 mol %, Uniform AgI type, Corresponding sphere diameter 0.4 μm, Variation coefficient of corresponding sphere diameter 30%, Plate-like grains, Diameter/thickness ratio 3.0) | as silver 0.35 |
| Silver iodobromide emulsion (AgI 6.0 mol %, High internal AgI type with core/shell ratio 1:2, Corresponding sphere diameter 0.45 μm, Variation coefficient of corresponding sphere diameter 23%, Plate-like grains, Diameter/thickness ratio 2.0) | as silver 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $2.0 \times 10^{-2}$ |
| ExC-3 | $4.0 \times 10^{-2}$ |
| ExC-4 | $2.0 \times 10^{-2}$ |
| ExC-5 | $8.0 \times 10^{-2}$ |
| ExC-6 | $2.0 \times 10^{-2}$ |
| ExC-9 | $1.0 \times 10^{-2}$ |
| Third Layer (Intermediate Speed Red Sensitive Emulsion Layer) | |
| Silver iodobromide emulsion (AgI 6.0 mol %, High internal AgI type with core/shell ratio 1:2, Corresponding sphere diameter 0.65 μm, Variation coefficient of corresponding sphere diameter 23%, Plate-like grains, Diameter/thickness ratio 2.0) | as silver 0.65 |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $2.5 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $3.0 \times 10^{-2}$ |
| ExC-8 | $1.0 \times 10^{-2}$ |
| ExC-9 | $3.0 \times 10^{-2}$ |
| Fourth Layer (High Speed Red Sensitive Emulsion Layer) | |
| Silver iodobromide emulsion (AgI 9.3 mol %, Multi-structure grains of core/shell ratio 3:4:2, AgI content from the inside 24, 0 and 6 mol %, Corresponding sphere diameter 0.75 gm, Variation coefficient of the corresponding sphere diameter 23%, Plate-like grains, Diameter/thickness ratio 2.5) | as silver 0.90 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| ExC-9 | $1.0 \times 10^{-2}$ |
| Solv-1 | 0.40 |
| Solv-2 | 0.15 |
| Fifth Layer (Intermediate Layer) | |
| Gelatin | 0.62 |
| Cpd-1 | 0.13 |
| Poly(ethyl acrylate) latex | $8.0 \times 10^{-2}$ |
| Solv-1 | $8.0 \times 10^{-2}$ |
| Sixth Layer (Low Speed Green Sensitive Emulsion Layer) | |
| Silver iodobromide emulsion (AgI 4.0 mol %, Uniform AgI type, Corresponding sphere diameter 0.45 μm, Variation Coefficient of corresponding sphere diameter 15%, Plate-like grains, Diameter/thickness | as silver 0.13 |

-continued

| | |
|---|---|
| ratio 4.0) | |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.14 |
| ExM-5 | $2.0 \times 10^{-2}$ |
| Solv-1 | 0.09 |
| Solv-3 | $7.0 \times 10^{-3}$ |
| Seventh Layer (Intermediate Speed Green Sensitive Emulsion Layer) | |
| Silver iodobromide emulsion (AgI 4.0 mol %, Uniform AgI type, Corresponding sphere diameter 0.65 μm, Variation Coefficient of corresponding sphere diameter 18%, Tabular grains, Diameter/thickness ratio 4.0) | as silver 0.31 |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.28 |
| ExM-5 | $7.2 \times 10^{-2}$ |
| ExY-1 | $5.4 \times 10^{-2}$ |
| Solv-1 | 0.23 |
| Solv-3 | $1.8 \times 10^{-2}$ |
| Eighth Layer (High Speed Green Sensitive Emulsion Layer) | |
| Silver iodobromide emulsion (AgI 9.8 mol %, Multi-structure grains of core/shell ratio 3:4:2, AgI content from the inside 24, 0 and 3 mol %,Corresponding sphere diameter 0.81 μm, Variation coefficient of the corresponding sphere diameter 23%, Multi-twinned crystal plate-like grains, Diameter/thickness ration 2.5) | as silver 0.49 |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-3 | $1.0 \times 10^{-2}$ |
| ExM-4 | $3.0 \times 10^{-2}$ |
| ExY-1 | $0.5 \times 10^{-2}$ |
| ExC-1 | $0.4 \times 10^{-2}$ |
| ExC-4 | $2.5 \times 10^{-3}$ |
| Twelfth Layer (Low Speed Blue Sensitive Emulsion Layer) | |
| Silver iodobromide emulsion (AgI 9.0 mol %, Multi-structure grains, Corresponding sphere diameter 0.70 μm, Variation Coefficient of the corresponding sphere diameter 20%, Tabular grains, Diameter/thickness ratio 7.0, Grains having 10 or more dislocations in the grain interior on examination with a 200 KV transmission type electron microscope accounting for more 50% of all of the grains.) | as silver 0.50 |
| Silver iodobromide emulsion (AgI 2.5 mol %, Uniform AgI type, Corresponding sphere diameter 0.50 μm, Variation coefficient of the corresponding sphere diameter 30%, Tabular grains, Diameter/thickness ratio 6.0) | as silver 0.30 |
| Gelatin | 2.18 |
| ExS-6 | $9.0 \times 10^{-4}$ |
| ExC-2 | 0.10 |
| ExY-2 | 0.05 |
| ExY-3 | 1.20 |
| Solv-1 | 0.54 |
| Thirteenth Layer (High Speed Blue Sensitive Emulsion Layer) | |
| Silver iodobromide emulsion (AgI 10.0 mol %, High internal AgI type, Corresponding sphere diameter 1.2 μm, Variation coefficient of corresponding sphere diameter 25%, Multi-twinned crystal plate-like grains, Diameter/thickness ratio 2.0) | as silver 0.40 |
| Gelatin | 0.59 |
| ExS-6 | $2.6 \times 10^{-4}$ |
| ExY-2 | $1.0 \times 10^{-2}$ |
| ExY-3 | 0.20 |
| ExC-1 | $1.0 \times 10^{-2}$ |
| Solv-1 | $9.0 \times 10^{-2}$ |
| Fourteenth Layer (First Protective Layer) | |
| Fine grained silver iodobromide emulsion (AgI 2.0 mol %, Uniform AgI type, Corresponding sphere diameter 0.07 um) | as silver 0.12 |
| Gelatin | 0.63 |
| UV-4 | 0.11 |
| UV-5 | 0.18 |
| Solv-4 | $2.0 \times 10^{-2}$ |
| Poly(ethyl acrylate) latex | $9.0 \times 10^{-2}$ |
| Fifteenth Layer (Second Protective Layer) | |
| Fine grained silver iodobromide emulsion (AgI 2.0 mol %, Uniform AgI type, Corresponding sphere diameter 0.07 um) | as silver 0.36 |
| Gelatin | 0.85 |
| B-1 (Diameter 2.0 μm) | $8.0 \times 10^{-2}$ |
| B-2 (Diameter 2.0 μm) | $8.0 \times 10^{-2}$ |
| B-3 | $2.0 \times 10^{-2}$ |
| W-4 | $2.0 \times 10^{-2}$ |
| H-1 | 0.18 |

In addition to the above-mentioned components, 1,2-benzisothiazolin-3-one (average 200 ppm with respect to the gelatin), n-butyl p-hydroxybenzoate (average 1,000 ppm with respect to the gelatin) and 2-phenoxyethanol (10,000 ppm with respect to the gelatin) were added to the sample prepared in this way. Moreover, B-4, B-5, B-6, F-1, F-2, F-3, F-4, F-5, F-6, F-7, F-8, F-9, F-10, F-11, F-12 and iron salts, lead salts, gold salts, platinum salts, iridium salts and rhodium salts were also included.

Furthermore, in addition to the components mentioned above, the surfactants W-1, W-2 and W-3 were added to each layer as coating promotors or emulsification and dispersing agents.

The chemical structural formulae of the compounds used in this invention are indicated below.

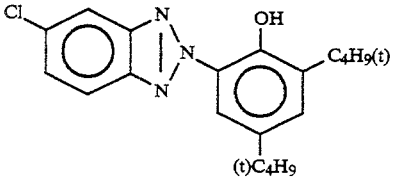

UV-1

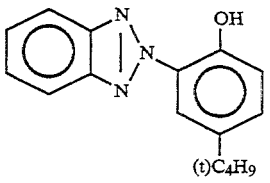

UV-2

-continued
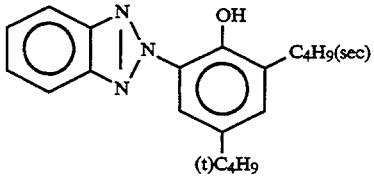
UV-3
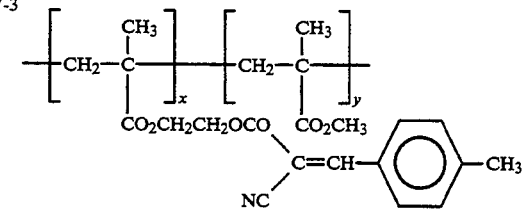
x:y = 70:30 (molar ratio)
UV-4
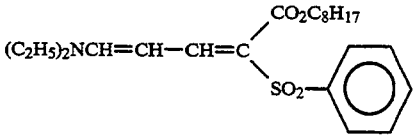
UV-5
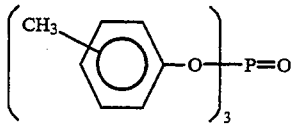
Solv-1
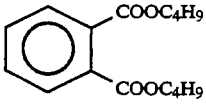
Solv-2
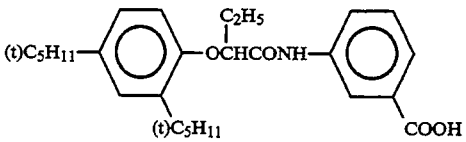
Solv-3
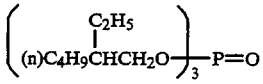
Solv-4
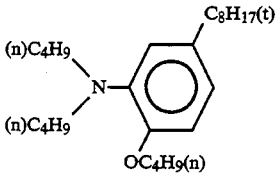
Solv-5
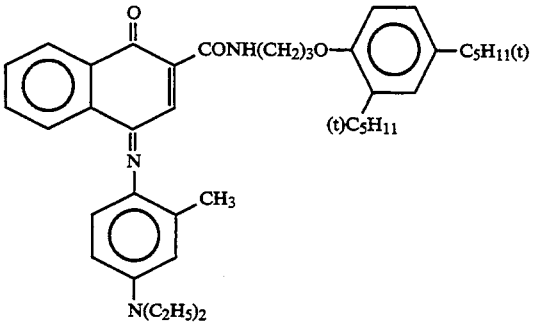
ExF-1
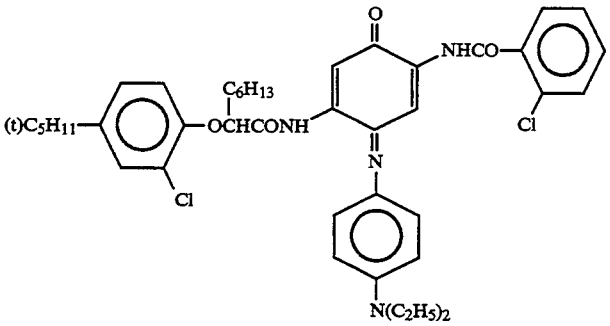
ExF-2
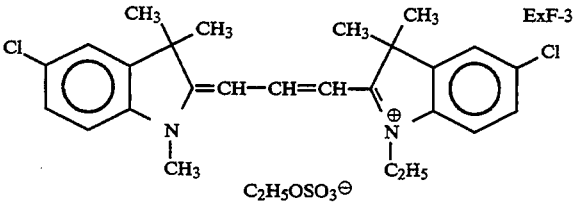
ExF-3
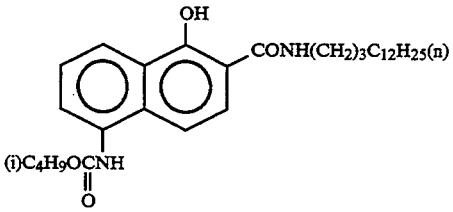
ExC-1

-continued
ExC-2
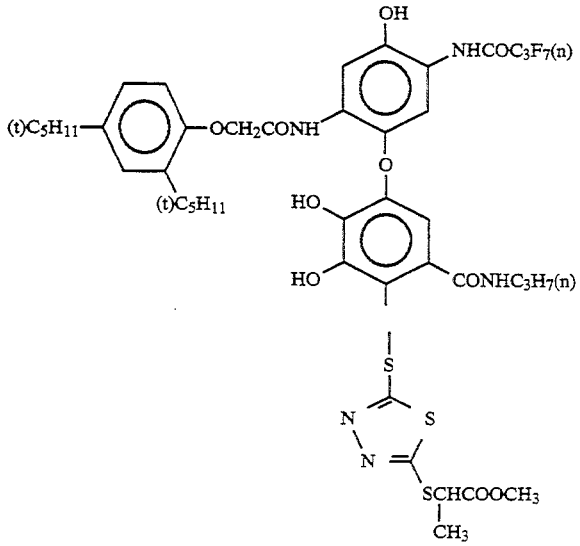
ExC-3
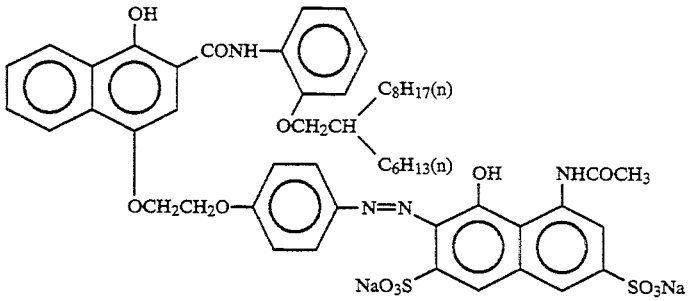
ExC-4
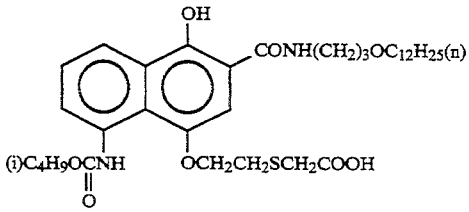
ExC-5
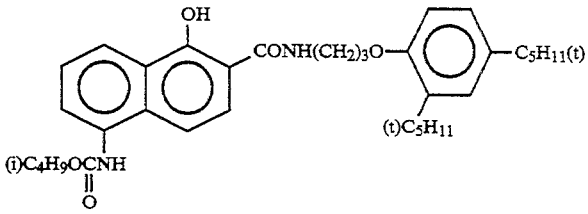
ExC-6
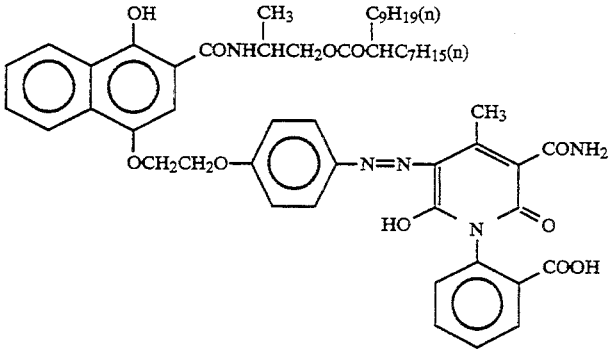

-continued
ExC-7
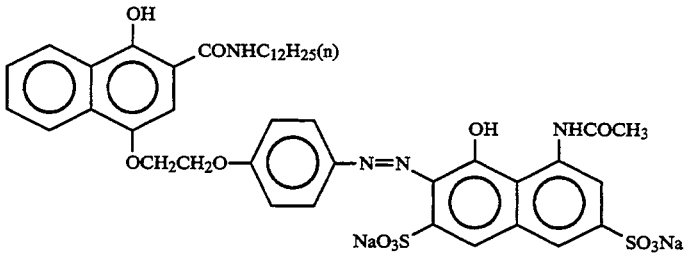
ExC-8
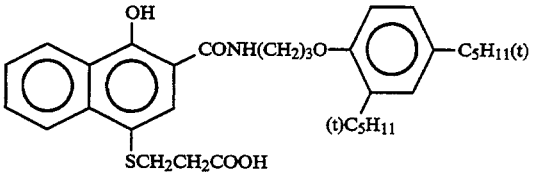
EXC-9
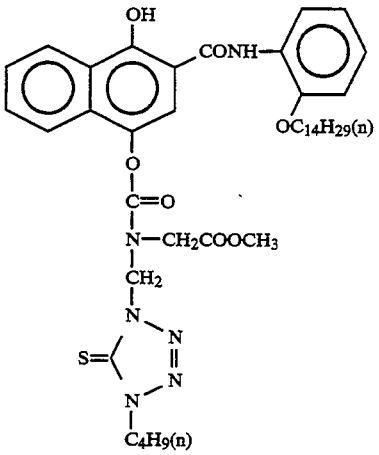
ExM-1
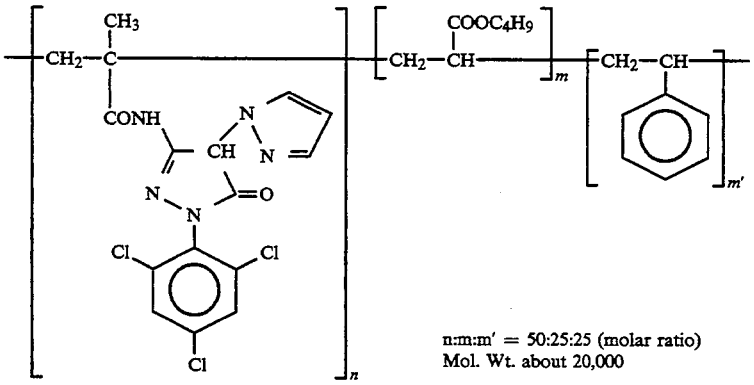
ExM-2
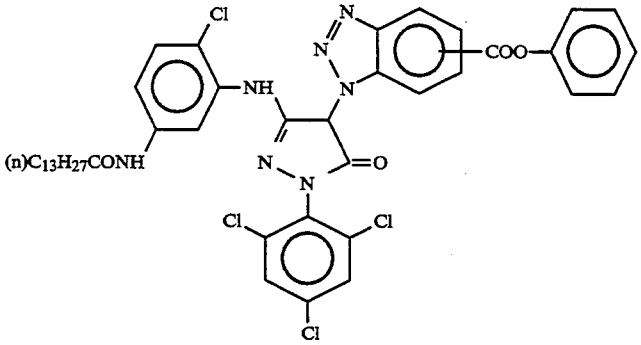

-continued
ExM-3
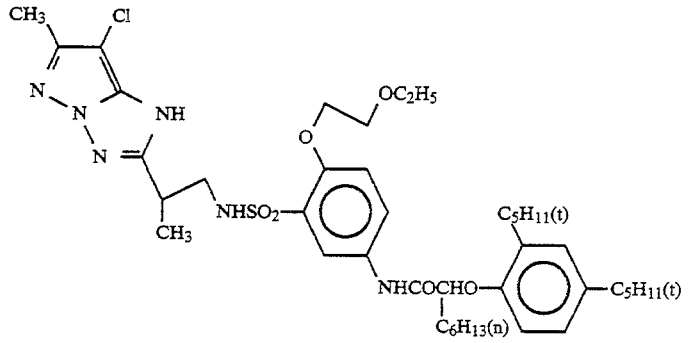
ExM-4
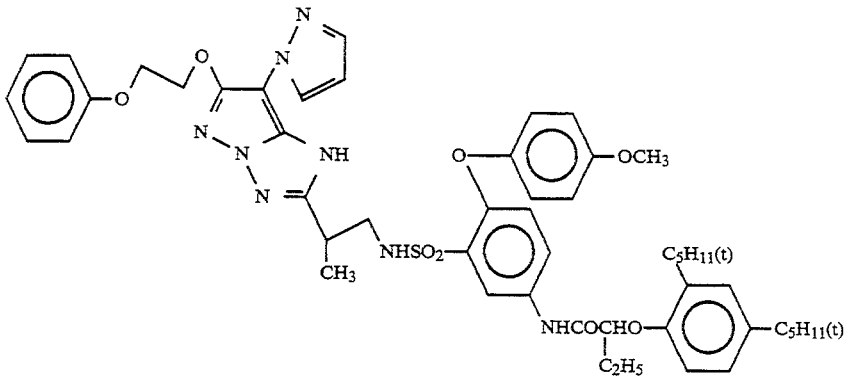
ExM-5
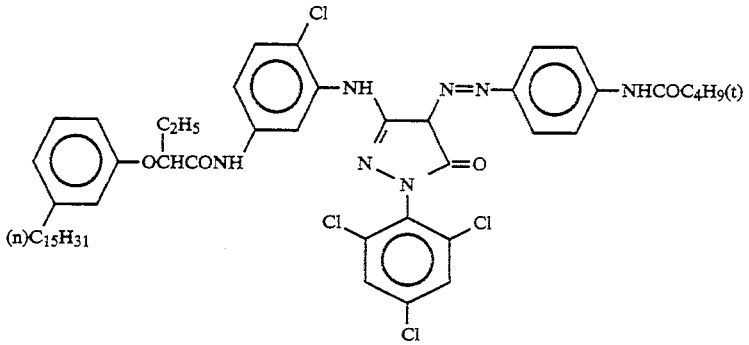
ExY-1
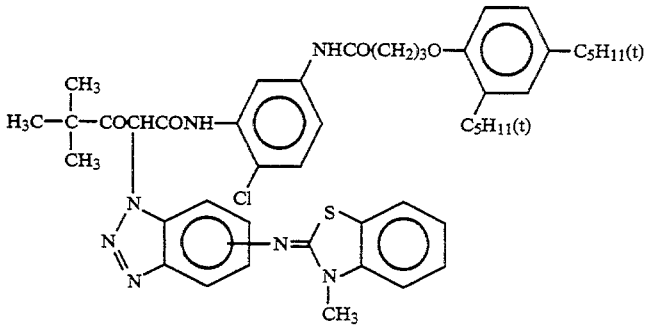
ExY-2
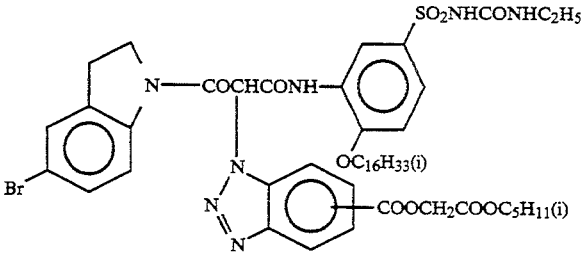

-continued
ExY-3
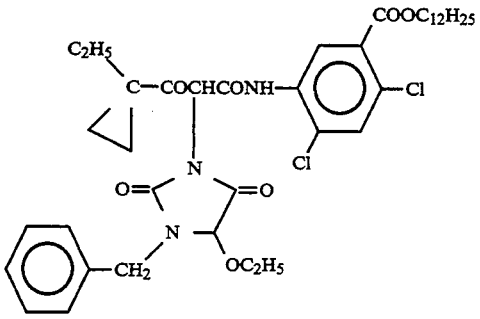
Cpd-1
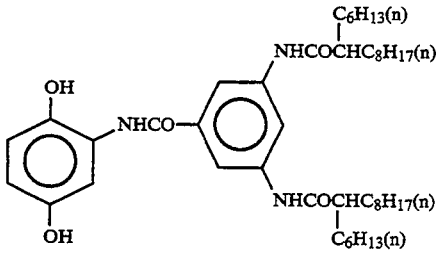
Cpd-2
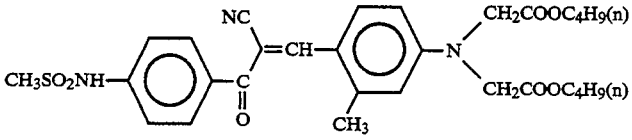
Cpd-3
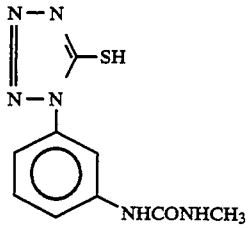
Cpd-4
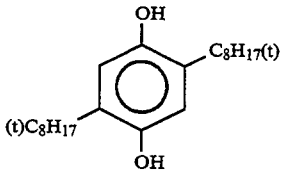
H-1
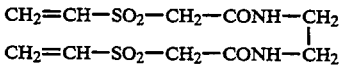
W-1
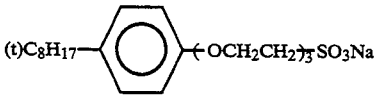
W-2
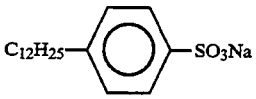
W-3
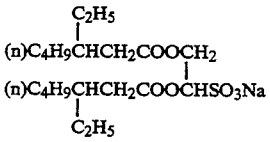
$C_8F_{17}SO_2N(C_3H_7)CH_2COOK$ W-4
ExS-1
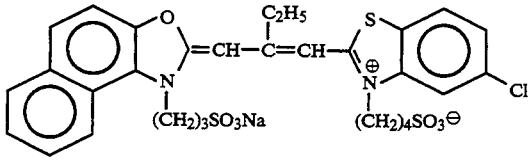
ExS-2
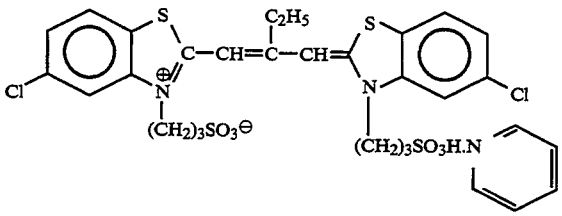
ExS-3
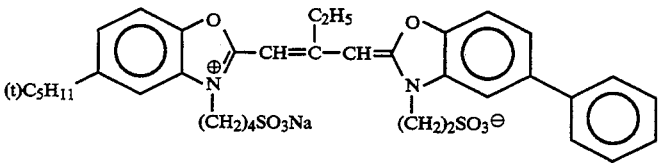

-continued
ExS-4
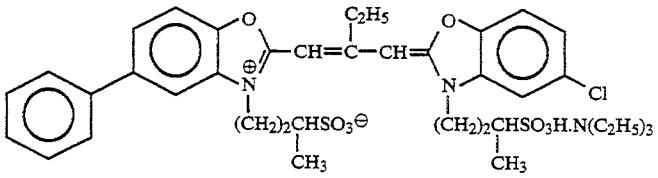
ExS-5
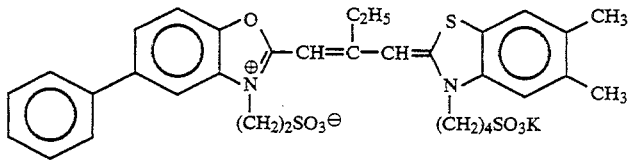
ExS-6
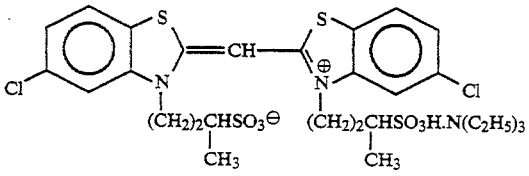
ExS-7
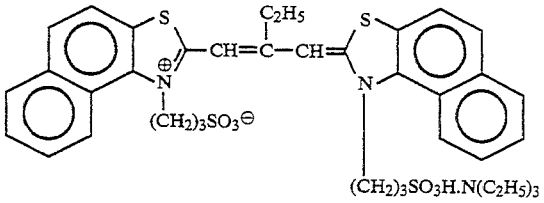
ExS-8
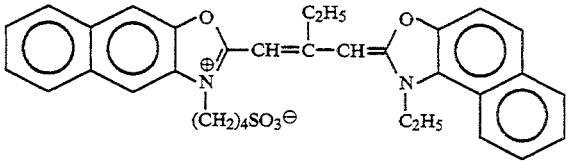
F-1
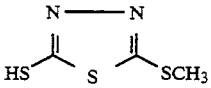
F-2
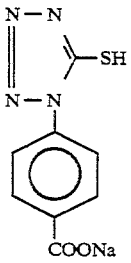
F-3
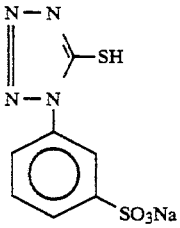
F-4
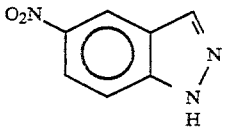
F-5
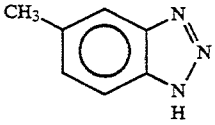
F-6
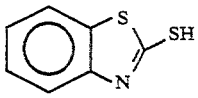
F-7
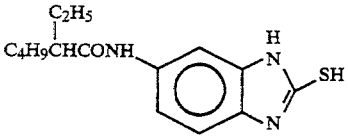
F-8
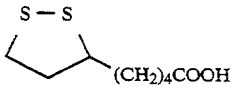

-continued

F-9

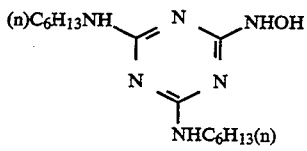

F-10

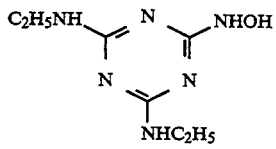

F-11

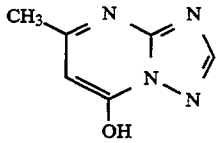

F-12

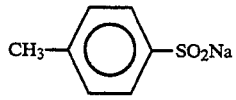

B-1

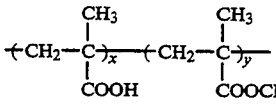

x/y = 10/90 (molar ratio)

B-2

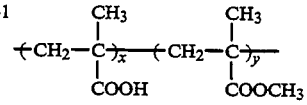

x/y = 40/60 (molar ratio)

B-3

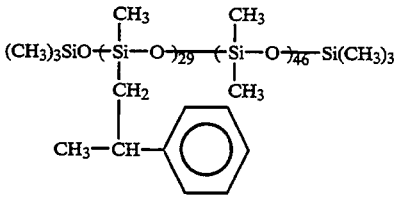

B-4

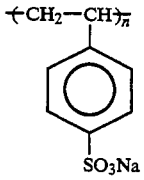

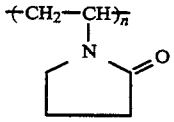

(Mol. Wt. about 10,000)

B-5

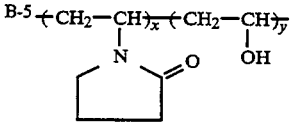

x/y = 70/30 (molar ratio)

B-6

Samples 102 to 111 were then prepared in the ways indicated below.

Preparation of Sample 102

Sample 102 was prepared by replacing the coupler ExM-2 used in the tenth layer of sample 101 with ExM-6 shown below.

ExM-6

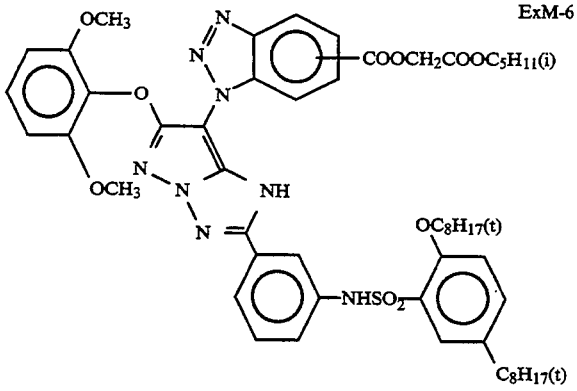

Preparation of Samples 103 to 105

Samples 103 to 105 were prepared by replacing the emulsion (1) in the tenth layer of sample 101 with the emulsions (2) to (4) shown in Table 1.

Preparation of Sample 106 to 111

Samples 106 to 111 were prepared by replacing the emulsion (1) in the tenth layer of sample 102 with the emulsions (2) to (7) shown in Table 1.

Samples 101 to 111 were subjected to a wedge exposure using white light and after processing as described below, and the photographic speeds and gradations obtained were more or less the same.

The graininess of the magenta images of these samples was measured with the usual RMS (root mean square) method. The evaluation of graininess with the RMS method is known to those concerned, but it has been described in *Photographic Science and Engineering*, Vol. 19, No. 4 (1975), pages 235 to 238 in a paper entitled "RMS Granularity; Determination of Just Noticeable Difference". A measuring aperture of 48 μm was used.

The results obtained are shown in Table 2.

Furthermore, with a view to evaluating the reproduction of the wavelengths of the spectrum, the principal wavelengths of reproduction were obtained using the method disclosed in JP-A-62-160448 for the samples 101 to 111. The difference between the wavelength $\lambda_o$ of the test light and the principal wavelength $\lambda$ of the color reproduced $(\lambda-\lambda_o)$ was obtained as the average for 450 nm to 600 nm using the following equation.

$$\Delta\lambda = \frac{\int_{450}^{600} (\lambda - \lambda_o)d\lambda}{600 - 450}$$

The results obtained are shown in Table 2. The test light was spectral light of exciting purity 0.7+ white light. The exposure was made with mixed white light at 0.05 lux·sec and 0.02 lux·sec. The latter should indicate better the characteristics of color reproduction on inadequate exposure.

The processing indicated below was carried out at 38° C. using an automatic processor.

| | |
|---|---|
| Color Development | 3 minutes 15 seconds |
| Bleach | 1 minute |
| Bleach-fix | 3 minutes 15 seconds |
| Water Wash (1) | 40 seconds |
| Water Wash (2) | 1 minute |
| Stabilization | 40 seconds |
| Drying (50° C.) | 1 minute 15 seconds |

Water washes (1) and (2) in the processing operations described above involved a counter-flow water washing system from (2) to (1). The composition of each processing bath is indicated below.

Moreover, the replenishment rate of the color developer was 1200 ml per square meter of color photosensitive material, and the replenishment rate of the other baths, including the water wash, was 800 ml per square meter of color photosensitive material. Furthermore, the carry-over of the previous bath to the water washing process was 50 ml per square meter of color photosensitive material.

Water Washing Water

Town water which contained 32 mg/liter of calcium ion and 7.3 mg/liter of magnesium ion was passed through a column which had been packed with an H-type strongly acidic cation exchange resin and an OH-type strongly basic anion exchange resin, and 20 mg per liter of sodium isocyanurate dichloride was added to the treated water which contained 1.2 mg/liter of calcium ion and 0.4 mg/liter of magnesium ion.

| Stabilizer (Parent Bath = Replenisher) | |
|---|---|
| Formalin (37% w/v) | 2.0 grams |
| Polyoxyethylene p-monononylphenyl ether (average degree of polymerization: 10) | 0.3 grams |
| Ethylenediamine tetra-acetic acid, di-sodium salt | 0.05 grams |
| Water to make | 1 liter |
| pH | 5.8 |

| | Parent Bath | Replenisher |
|---|---|---|
| Color Developer | | |
| Diethylenetriamine pentaacetic acid | 1.0 gram | 1.1 grams |
| 1-Hydroxyethylidene-1,1-diphosphonic acid | 2.0 grams | 2.2 grams |
| Sodium sulfite | 4.0 grams | 4.4 grams |
| Potassium carbonate | 30.0 grams | 32.0 grams |
| Potassium bromide | 1.4 grams | 0.7 grams |
| Potassium iodide | 1.3 mg | — |
| Hydroxylamine sulfate | 2.4 grams | 2.6 grams |
| 4-(N-Ethyl-N-β-hydroxyethylamino)-2-methylaniline sulfate | 4.5 grams | 5.0 grams |
| Water to make | 1.0 liter | 1.0 liter |
| pH | 10.00 | 10.05 |

| Bleach (Parent Bath = Replenisher) | |
|---|---|
| Ethylenediamine tetra-acetic acid, ferric ammonium salt | 120 grams |
| Ethylenediamine tetra-acetic acid, disodium salt | 10.0 grams |
| Ammonium nitrate | 10.0 grams |
| Ammonium bromide | 100.0 grams |
| Bleach accelerator | $5 \times 10^{-3}$ mol |

Represented by the following formula:

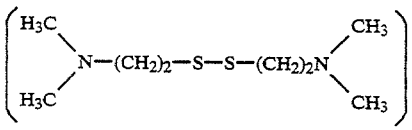

| | |
|---|---|
| Aqueous ammonia to adjust to pH | 6.3 |
| Water to make | 1.0 liter |

| Bleach-Fixer (Parent Bath = Replenisher) | |
|---|---|
| Ethylenediamine tetra-acetic acid, ferric ammonium salt | 50.0 grams |
| Ethylenediamine tetra-acetic acid, disodium salt | 5.0 grams |
| Sodium sulfite | 12.0 grams |
| Aqueous ammonium thiosulfate solution (70%) | 240 ml |
| Ammonia to adjust to pH | 7.3 |
| Water to make | 1 liter |

Drying

The drying temperature was set to 50° C.

TABLE 2

| Sample No. | Emulsion | Tenth Layer Coupler | R.M.S. of Magenta ($\times 10^{-4}$) D = fog + 0.5 | R.M.S. of Magenta ($\times 10^{-4}$) D = fog + 1.0 | Δλ 0.05 lux · sec | Δλ 0.021 lux · sec | |
|---|---|---|---|---|---|---|---|
| 101 | (1) | ExM-2 | 11 | 10 | 2.1 | 3.6 | Comparative Example |
| 102 | (1) | ExM-6 | 12 | 10 | 2.0 | 3.4 | Comparative Example |
| 103 | (2) | ExM-2 | 14 | 12 | 2.2 | 3.5 | Comparative Example |
| 104 | (3) | " | 6 | 6 | 2.2 | 3.5 | Comparative |

TABLE 2-continued

| Sample No. | Emulsion | Tenth Layer Coupler | R.M.S. of Magenta ($\times 10^{-4}$) D = fog + 0.5 | D = fog + 1.0 | Δλ 0.05 lux · sec | 0.021 lux · sec | |
|---|---|---|---|---|---|---|---|
| 105 | (4) | " | 7 | 7 | 2.1 | 3.6 | Example Comparative Example |
| 106 | (2) | ExM-6 | 13 | 13 | 2.0 | 3.7 | Comparative Example |
| 107 | (3) | " | 6 | 6 | 1.7 | 3.1 | This Invention |
| 108 | (4) | " | 6 | 7 | 1.8 | 3.0 | This Invention |
| 109 | (5) | " | 13 | 10 | 2.1 | 3.4 | Comparative Example |
| 110 | (6) | " | 5 | 4 | 1.6 | 2.9 | This Invention |
| 111 | (7) | " | 4 | 3 | 1.7 | 3.0 | This Invention |

Samples 107, 108, 110 and 111 of this present invention were markedly improved in terms of color reproduction and R.M.S. graininess when compared with comparative samples 101 to 106 and 109 in which conventional dyes or development inhibitor releasing compounds had been used, so the effect of the invention is therefore clear.

The fact that the R.M.S. graininess can be improved without loss of color reproduction by using the sensitizing dye ExS-4 or ExS-5 conjointly with sensitizing dyes of this present invention is clear on comparing samples 107 and 108 and samples 110 and 111.

EXAMPLE 3

Samples 101 to 111 of Example 2 were finished in the form of "Quick Snap Flash" as made by the Fuji Photographic Film Co., photographs were taken using the lens-fitted film, and an evaluation was carried out. In this case, the samples of the present invention again gave good print quality, and the improving effect of the present invention was clear.

While the invention has been described in detail and with reference to specific embodiments thereof, it will be apparent to one skilled in the art that various changes and modifications can be made therein without departing from the spirit and scope thereof.

What is claimed is:

1. A silver halide color photosensitive material comprising a support having thereon at least one blue sensitive silver halide emulsion layer which contains a yellow color forming color coupler, at least one green sensitive silver halide emulsion layer which contains a magenta color forming color coupler and at least one red sensitive silver halide emulsion layer which contains a cyan color forming color coupler, and in which at least one light-sensitive silver halide emulsion layer imparts an interlayer effect to the red sensitive emulsion layer, wherein the layer which imparts the interlayer effect is spectrally sensitized with a sensitizing dye represented by formula (I), and includes a development inhibitor releasing compound represented by formula (II):

Formula (I)

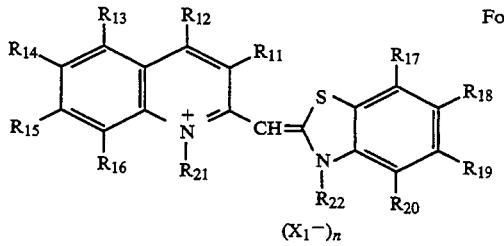

wherein $R_{11}$, $R_{12}$, $R_{13}$, $R_{14}$, $R_{15}$, $R_{16}$, $R_{17}$, $R_{18}$, $R_{19}$ and $R_{20}$, which are the same or different, each represent a hydrogen atom, an alkyl group, an aryl group, an alkoxy group, an aryloxy group, a halogen atom, an aryloxycarbonyl group, an alkoxycarbonyl group, an amino group, an acyl group, a cyano group, a carbamoyl group, a sulfamoyl group, a carboxyl group or an acyloxy group, $R_{21}$ and $R_{22}$, which are the same or different, each represent an alkyl group, $X_1^-$ represents a counteranion, n is 0 or 1, and n=0 in cases where an intramolecular salt is formed;

Formula (II)

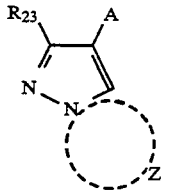

wherein $R_{23}$ represents a hydrogen atom or a substituent group, Z represents a group of non-metal atoms which is required to form a five-membered azole ring which contains from 2 to 4 nitrogen atoms, wherein the azole ring may have substituent groups, A represents a group which is eliminated by a coupling reaction with an oxidized form of a developing agent to form a development inhibitor or a precursor thereof, or A represents a group which is eliminated by a coupling reaction with an oxidized form of a developing agent and then reacts with another molecule of an oxidized form of a developing agent to form a development inhibitor or a precursor thereof.

2. The silver halide color photosensitive material as in claim 1, wherein a sensitizing dye represented by formula (III) is included in the layer which imparts an interlayer effect on the red sensitive emulsion layer:

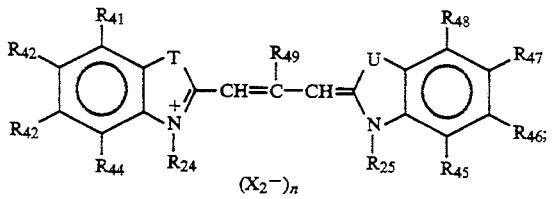

wherein $R_{41}$ to $R_{48}$ have the same meaning as $R_{11}$, $R_{24}$ and $R_{25}$ have the same meaning as $R_{21}$, T and U are either oxygen atoms, sulfur atoms or selenium atoms and are the same or different, $X_2^-$ has the same meaning as $X_1^-$, and $R_{49}$ represents a hydrogen atom, an alkyl group or an aryl group.

3. The silver halide color photosensitive material as in claim 1, wherein $R_{11}$ and $R_{13}$ represent hydrogen atoms, $R_{12}$ represents a chlorine atom or a phenyl group, $R_{14}$ represents a chlorine atom or a phenyl group, and $R_{21}$ and $R_{22}$ each represent an alkyl group having up to 8 carbon atoms or an aralkyl group having up to 10 carbon atoms.

4. The silver halide color photosensitive material as in claim 3, wherein $R_{21}$ and $R_{22}$ each represent a sulfoethyl group, a sulfopropyl group, a sulfobutyl group, a 1-methylsulfopropyl group, a carboxymethyl group or a carboxyethyl group.

5. The silver halide color photosensitive material as in claim 1, wherein said development inhibitor releasing compound of formula (II) is represented by formula (P-1), (P-2), (P-3) or (P-4);

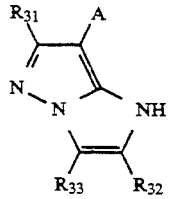

(P-1)

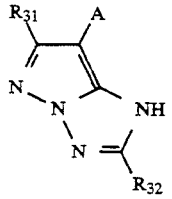

(P-2)

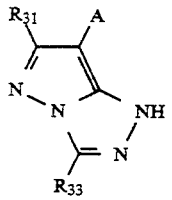

(P-3)

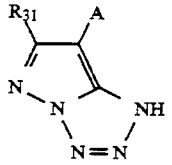

(P-4)

wherein $R_{31}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group, and $R_{31}$ may also be a divalent group and form bis-forms, $R_{32}$ represents a hydrogen atom, alkyl group, an aryl group, a heterocyclic group, an alkoxycarbonyl group, a carbamoyl group, a sulfamoyl group, a sulfinyl group, an acyl group or a cyano group, $R_{33}$ represents a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, and A is a group represented by formula (A-1)

$$-\{(L_1)_a-(B)_m\}_p-(L_2)_n-DI \qquad \text{(A-1)}$$

wherein $L_1$ represents a group with which the bond between $(L_1)_a$ and $(B)_m$ is cleaved after cleavage of the bond between $(L_1)_a$ and the carbon atom to which A is bonded, B represents a group which reacts with the oxidized form of a developing agent and with which the bond between $(B)_m$ and $(L_2)_n$ is cleaved, $L_2$ represents a group with which the bond between $(L_2)_n$ and DI is cleaved after cleavage of the bond between $(L_2)_n$ and $(B)_m$, DI represents a development inhibitor, a, m and n each represent 0 or 1, and p represents an integer of 0 to 2.

6. The silver halide color photosensitive material as in claim 5, wherein $R_{31}$ represents a hydrogen atom, an alkyl group, an aryl group, an alkoxy group, an aryloxy group, an alkylthio group, a ureido group, a urethane group or an acylamino group.

7. The silver halide color photosensitive material as in claim 1, wherein said sensitizing dye of formula (I) is used in an amount of from $4\times10^{-6}$ to $2\times10^{-2}$ mol, per mol of silver halide contained in the layer which imparts the interlayer effect, and said development inhibitor releasing compound of formula (II) is contained in an amount of from 0.01 to 0.85 g/m$^2$.

8. The silver halide color photosensitive material as in claim 7, wherein said sensitizing dye of formula (I) is used in an amount of from $5\times10^{-5}$ to $5\times10^{-3}$ mol, per mol of silver halide contained in the layer which imparts the interlayer effect.

9. The silver halide color photosensitive material as in claim 2, wherein said sensitizing dye of formula (III) is used in an amount of 0.5 to 80 mol % of the amount of the dye of formula (I).

10. The silver halide color photosensitive material as in claim 1, wherein silver halides contained in light-sensitive silver halide emulsion layers of the color photosensitive material are silver iodobromides, silver iodochlorides or silver iodochlorobromides which contain not more than 30 mol % of silver iodide.

11. The silver halide color photosensitive material as in claim 10, wherein said silver halides contain 2 to 10 mol % of silver iodide.

* * * * *